US007504127B2

(12) United States Patent
Karayianni et al.

(10) Patent No.: US 7,504,127 B2
(45) Date of Patent: Mar. 17, 2009

(54) ELECTRICALLY CONDUCTIVE ELASTIC COMPOSITE YARN, METHODS FOR MAKING THE SAME, AND ARTICLES INCORPORATING THE SAME

(75) Inventors: Eleni Karayianni, Geneva (CH); Omero Consoli, Geneva (CH); George W. Coulston, Pittsburgh, PA (US); Klaus J. Regenstein, Buedingen (DE)

(73) Assignee: Textronics Inc., Wilmington, DE (US)

( * ) Notice: Subject to any disclaimer, the term of this patent is extended or adjusted under 35 U.S.C. 154(b) by 63 days.

(21) Appl. No.: 11/553,206

(22) Filed: Oct. 26, 2006

(65) Prior Publication Data

US 2007/0054037 A1 Mar. 8, 2007

Related U.S. Application Data

(62) Division of application No. 10/825,498, filed on Apr. 15, 2004, now Pat. No. 7,135,227.

(60) Provisional application No. 60/465,571, filed on Apr. 25, 2003.

(51) Int. Cl.
*B05D 7/20* (2006.01)

(52) U.S. Cl. ..... 427/118; 427/116; 427/117; 427/123

(58) Field of Classification Search ..... 427/116, 427/117, 118, 123
See application file for complete search history.

(56) References Cited

U.S. PATENT DOCUMENTS

| | | | |
|---|---|---|---|
| 3,288,175 | A | 11/1966 | Valko |
| 4,525,992 | A | 7/1985 | Payen et al. |
| 4,654,748 | A | 3/1987 | Rees |
| 4,777,789 | A | 10/1988 | Kolmes et al. |
| 4,813,219 | A | 3/1989 | Rees |
| 4,878,148 | A | 10/1989 | Hee et al. |
| 5,288,544 | A | 2/1994 | Mallen et al. |
| 5,632,137 | A | 5/1997 | Kolmes et al. |
| 5,927,060 | A | 7/1999 | Watson |
| 6,105,224 | A | 8/2000 | O'Mara, Jr. et al. |

(Continued)

FOREIGN PATENT DOCUMENTS

| | | |
|---|---|---|
| GB | 2156592 | 10/1985 |

(Continued)

*Primary Examiner*—Andrew T Piziali
(74) *Attorney, Agent, or Firm*—Connolly Bove Lodge & Hutz LLP

(57) ABSTRACT

An electrically conductive elastic composite yarn comprises an elastic member that is surrounded by at least one conductive covering filament(s). The elastic member has a predetermined relaxed unit length L and a predetermined drafted length of (N×L), where N is a number preferably in the range from about 1.0 to about 8.0. The conductive covering filament has a length that is greater than the drafted length of the elastic member such that substantially all of an elongating stress imposed on the composite yarn is carried by the elastic member. The elastic composite yarn may further include an optional stress-bearing member surrounding the elastic member and the conductive covering filament. The length of the stress-bearing member is less than the length of the conductive covering filament and greater than, or equal to, the drafted length (N×L) of the elastic member, such that a portion of the elongating stress imposed on the composite yarn is carried by the stress-bearing member.

8 Claims, 20 Drawing Sheets

U.S. PATENT DOCUMENTS

| | | | |
|---|---|---|---|
| 6,341,504 | B1 | 1/2002 | Istook |
| 6,581,366 | B1 | 6/2003 | Andrews |
| 2002/0050446 | A1 | 5/2002 | Antoniazzi |
| 2002/0189839 | A1 | 12/2002 | Wagner et al. |
| 2005/0282009 | A1 | 12/2005 | Nusko et al. |

FOREIGN PATENT DOCUMENTS

| | | |
|---|---|---|
| WO | WO-2004/027132 | 4/2004 |

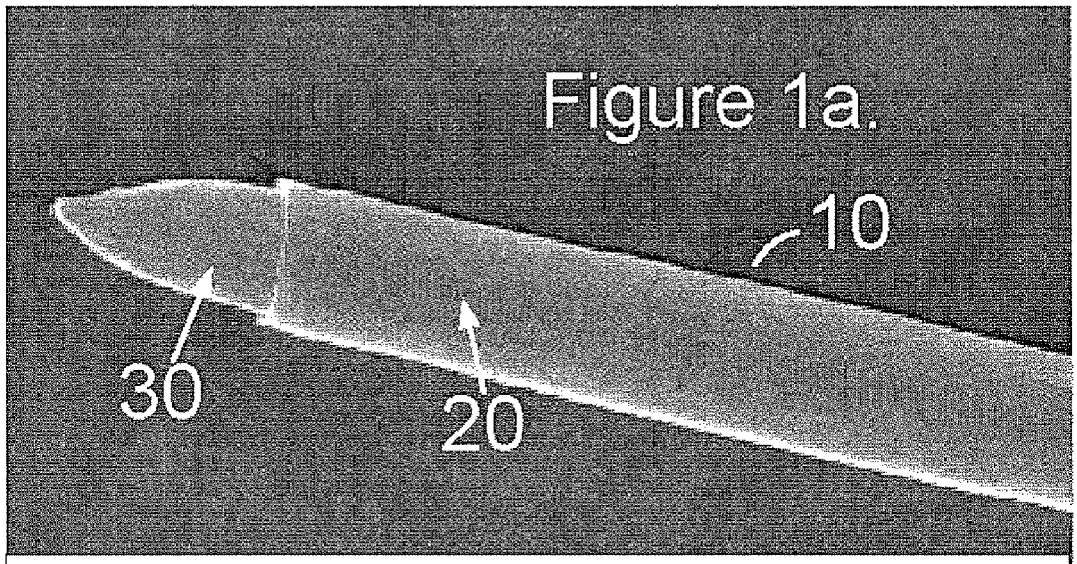
PRIOR ART
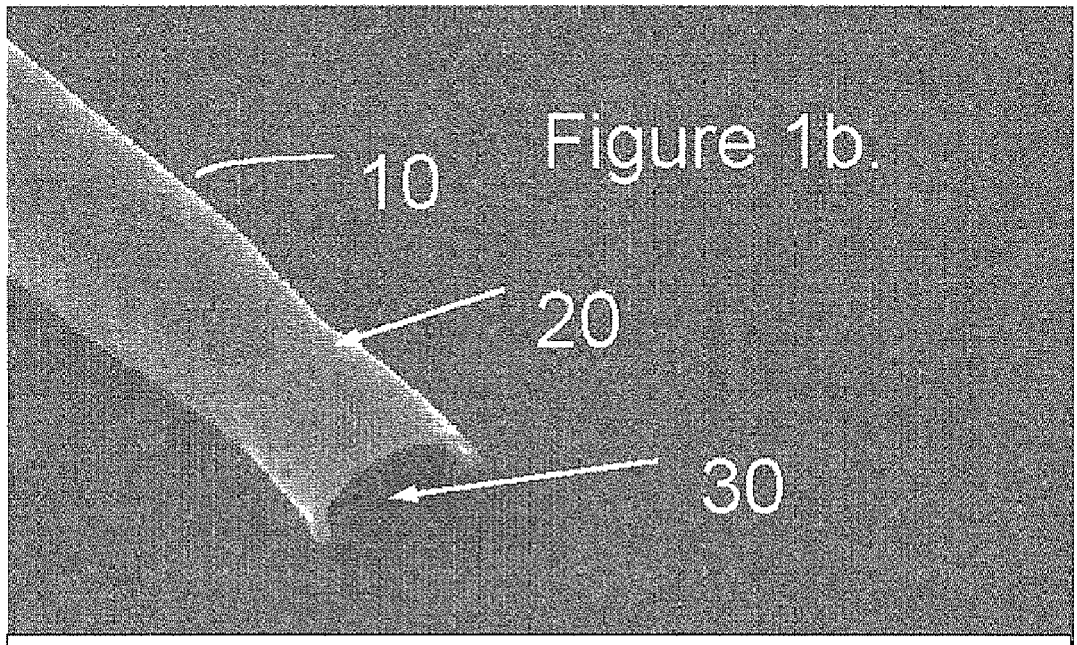
PRIOR ART

PRIOR ART

Force (cN)
50
40
30
20
10
0
10
50
0
50
100
150
200
250
Elongation (%)

Force (cN)
50
40
30
20
10
0
10
50
0
50
100
Elongation (%)

Force (cN)
50
40
30
20
10
0
60
10
0
50
100
150
200
250
Elongation (%)

60
50
40
30
20
10
0
Force (cN)
90
10
0
50
100
150
200
250
Elongation (%)

100

100

110

110

ELECTRICALLY CONDUCTIVE ELASTIC COMPOSITE YARN, METHODS FOR MAKING THE SAME, AND ARTICLES INCORPORATING THE SAME

CROSS-REFERENCE TO RELATED APPLICATIONS

This application is a divisional of U.S. application Ser. No. 10/825,498, filed Apr. 15, 2004, now U.S. Pat. No. 7,135,227, which claims the benefit of U.S. Provisional Application No. 60/465,571, filed on Apr. 25, 2003, which provisional application is incorporated in its entirety as a part hereof for all purposes.

FIELD OF THE INVENTION

The present invention relates to elastified yarns containing conductive metallic filaments, a process for producing the same, and to stretch fabrics, garments and other articles incorporating such yarns.

BACKGROUND OF THE INVENTION

It is known to include in textile yarns metallic wires and to include metallic surface coatings on yarns for the purpose of carrying electrical current, performing an anti-static electricity function or to provide shielding from electric fields. Such electrically conductive composite yarns have been fabricated into fabrics, garments and apparel articles.

It is believed impractical to base a conductive textile yarn solely on metallic filaments or on a combination yarn where the metallic filaments are required to be a stressed member of the yarn. This is due to the fragility and especially poor elasticity of the fine metal wires heretofore used in electrically conducting textile yarns.

Sources of fine metal wire fibers for use in textiles include, but are not limited to: N V Bekaert S A, Kortrijk, Belgium; Elektro-Feindraht A G, Escholzmatt, Switzerland and New England Wire Technologies Corporation, Lisbon, New Hampshire. As illustrated in FIG. 1*a* such wires 10 have an outer coating 20 of an insulating polymeric material surrounding a conductor 30 having a diameter on the order of 0.02 mm-0.35 mm and an electrical resistivity in the range of 1 to 2 microohm-cm. In general, these metal fibers exhibit a low force to break and relativity little elongation. As shown in FIG. 2 these metal filaments have a breaking strength in the range of 260 to 320 N/mm$^2$ and an elongation at break of about 10 to 20%. However, these wires exhibit substantially no elastic recovery. In contrast, many elastic synthetic polymer based textile yarns stretch to at least 125% of their unstressed specimen length and recover more than 50% of this elongation upon relaxation of the stress.

U.S. Pat. No. 3,288,175 (Valko) discloses an electrically conductive elastic composite yarn containing nonmetallic and metallic fibers. The nonmetallic fibers used in this composite conducting yarn are textile fibers such as nylon, polyester, cotton, wool, acrylic and polyolefins. These textile fibers have no inherent elasticity and impart no "stretch and recovery" power. Although the composite yarn of this reference is an electrically conductive yarn, textile material made therefrom fail to provide textile materials having a stretch potential.

Similarly, U.S. Pat. No. 5,288,544 (Mallen et al.) discloses an electrically conductive fabric comprising a minor amount of conductive fiber. This reference discloses conductive fibers including stainless steel, copper, platinum, gold, silver and carbon fibers comprising from 0.5% to 2% by weight. This patent discloses, by way of example, a woven fabric towel comprising polyester continuous filaments wrapped with carbon fibers and a spun polyester (staple fiber) and steel fiber yarn where the steel fiber is 1% by weight of the yarn. While fabrics made from such yarns may have satisfactory antistatic properties apparently satisfactory for towels, sheets, hospital gowns and the like; they do not appear to possess an inherent elastic stretch and recovery property.

U.S. Patent Application 2002/0189839A1, published 19 Dec. 2002, (Wagner et al.), discloses a cable to provide electrical current suitable for Incorporation Into apparel, clothing accessories, soft furnishings, upholstered items and the like. This application discloses electric current or signal carrying conductors in fabric-based articles based on standard flat textile structures of woven and knitted construction. An electrical cable disclosed in this application includes a "spun structure" comprising at least one electrically conductive element and at least one electrically insulating element. No embodiments appear to provide elastic stretch and recovery properties. For applications of the type contemplated the inability of the cable to stretch and recover from stretch is a severe limitation which limits the types of apparel applications to which this type of cable is suited.

Stretch and recovery is an especially desirable property of a yarn, fabric or garment which is also able to conduct electrical current, perform in antistatic electricity applications or provide electric field shielding. The stretch and recovery property, or "elasticity", is ability of a yarn or fabric to elongate in the direction of a biasing force (in the direction of an applied elongating stress) and return substantially to its original length and shape, substantially without permanent deformation, when the applied elongating stress is relaxed. In the textile arts it is common to express the applied stress on a textile specimen (e. g. a yarn or filament) in terms of a force per unit of cross section area of the specimen or force per unit linear density of the unstretched specimen. The resulting strain (elongation) of the specimen is expressed in terms of a fraction or percentage of the original specimen length. A graphical representation of stress versus strain is the stress-strain curve, well-known in the textile arts.

The degree to which fiber, yarn or fabric returns to the original specimen length prior to being deformed by an applied stress is called "elastic recovery". In stretch and recovery testing of textile materials it is also important to note the elastic limit of the test specimen. The elastic limit is the stress load above which the specimen shows permanent deformation. The available elongation range of an elastic filament is that range of extension throughout which there is no permanent deformation. The elastic limit of a yarn is reached when the original test specimen length is exceeded after the deformation inducing stress is removed. Typically, Individual filaments and multifilament yarns elongate (strain) in the direction of the applied stress. This elongation is measured at a specified load or stress. In addition, it is useful to note the elongation at break of the filament or yarn specimen. This breaking elongation is that fraction of the original specimen length to which the specimen is strained by an applied stress which ruptures the last component of the specimen filament or multifilament yarn. Generally, the drafted length is given in terms of a draft ratio equal to the number of times a yarn is stretched from its relaxed unit length.

Elastic fabrics having conductive wiring affixed to the fabric for use in garments intended for monitoring of physiological functions in the body are disclosed in U.S. Pat. No. 6,341,504 (Istook). This patent discloses an elongated band of elastic material stretchable in the longitudinal direction and having at least one conductive wire incorporated into or onto the elastic fabric band. The conductive wiring in the elastic fabric band is formed in a prescribed curved configuration, e.g., a sinusoidal configuration. The elastic conductive band of this patent is able to stretch and alter the curvature of the conduction wire. As a result the electrical inductance of the wire is changed. This property change is used to determine changes in physiological functions of the wearer of a garment including such a conductive elastic band. The elastic band is formed in part using an elastic material, preferably spandex. Filaments of the spandex material sold by DuPont Textiles and Interiors, Inc., Wilmington, Del., under the trademark LYCRA® are disclosed as being a desirable elastic material. Conventional textile means to form the conductive elastic band are disclosed, these include warp knitting, weft knitting, weaving, braiding, or non-woven construction. Other textile filaments in addition to metallic filaments and spandex filaments are included in the conductive elastic band, these other filaments including nylon and polyester.

While elastic conductive fabrics with stretch and recovery properties dominated by the spandex component of the composite fabric band are disclosed, these conductive fabric bands are intended to be discrete elements of a fabric construction or garment used for prescribed physiological function monitoring. Although such elastic conductive bands may have advanced the art in physiological function monitoring they have not shown to be satisfactory for use in a way other than as discrete elements of a garment or fabric construction.

In view of the foregoing it is believed desirable to provide a conductive textile yarn with elastic recovery properties which can be processed using traditional textile means to produce knitted, woven or nonwoven fabrics. Further, it is believed that there is yet a need for fabrics and garments which are substantially wholly constructed from such elastic conductive yarns. Fabrics and garments substantially wholly constructed from elastic conductive yarns provide stretch and recovery characteristic to the entire construction, conforming to any shape, any shaped body, or requirement for elasticity.

SUMMARY OF THE INVENTION

The present invention is directed to an electrically conducting elastic composite yarn that comprises an elastic member having a relaxed unit length L and a drafted length of (N×L). The elastic member itself comprises one or more filaments with elastic stretch and recovery properties. The elastic member is surrounded by at least one, but preferably a plurality of two or more, conductive covering filament(s). Each conductive covering filament has a length that is greater than the drafted length of the elastic member such that substantially all of an elongating stress imposed on the composite yarn is carried by the elastic member. The value of the number N is in the range of about 1.0 to about 8.0; and, more preferably, in the range of about 1.2 to about 5.0.

Each of the conductive covering filament(s) may take any of a variety of forms. The conductive covering filament may be in the form of a metallic wire, including a metallic wire having an insulating coating thereon. Alternatively the conductive covering filament may take the form of a non-conductive inelastic synthetic polymer yarn having a metallic wire thereon. Any combination of the various forms may be used together in a composite yarn having a plurality of conductive covering filament(s).

Each conductive covering filament is wrapped in turns about the elastic member such that for each relaxed (stress free) unit length (L) of the elastic member there is at least one (1) to about 10,000 turns of the conductive covering filament. Alternatively, the conductive covering filament may be sinuously disposed about the elastic member such that for each relaxed unit length (L) of the elastic member there is at least one period of sinuous covering by the conductive covering filament.

The composite yarn may further comprise one or more inelastic synthetic polymer yarn(s) surrounding the elastic member. Each inelastic synthetic polymer filament yarn has a total length less than the length of the conductive covering filament, such that a portion of the elongating stress imposed on the composite yarn is carried by the inelastic synthetic polymer yarn(s). Preferably, the total length of each inelastic synthetic polymer filament yarn is greater than or equal to the drafted length (N×L) of the elastic member.

One or more of the inelastic synthetic polymer yarn(s) may be wrapped about the elastic member (and the conductive covering filament) such that for each relaxed (stress free) unit length (L) of the elastic member there is at least one (1) to about 10,000 turns of inelastic synthetic polymer yarn. Alternatively, the inelastic synthetic polymer yarn(s) may be sinuously disposed about the elastic member such that for each relaxed unit length (L) of the elastic member there is at least one period of sinuous covering by the inelastic synthetic polymer yarn.

The composite yarn of the present invention has an available elongation range from about 10% to about 800%, which is greater than the break elongation of the conductive covering filament and less than the elastic limit of the elastic member, and a breaking strength greater than the breaking strength of the conductive covering filament.

The present invention is also directed to various methods for forming an electrically conductive elastic composite yarn.

A first method includes the steps of drafting the elastic member used within the composite yarn to its drafted length, placing each of the one or more conductive covering filament(s) substantially parallel to and in contact with the drafted length of the elastic member; and thereafter allowing the elastic member to relax thereby to entangle the elastic member and the conductive covering filament(s). If the electrically conducting elastic composite yarn includes one or more inelastic synthetic polymer yarn(s) such inelastic synthetic polymer yarn(s) are placed substantially parallel to and in contact with the drafted length of the elastic member; and thereafter the elastic member is allowed to relax thereby to entangle the inelastic synthetic polymer yarn(s) with the elastic member and the conductive covering filament(s).

In accordance with other alternative methods, each of the conductive covering filament(s) and each of the inelastic synthetic polymer yarn(s) (if the same are provided) are either twisted about the drafted elastic member or, in accordance with another embodiment of the method, wrapped about the drafted elastic member. Thereafter, in each instance, the elastic member is allowed to relax.

Yet another alternative method for forming an electrically conducting elastic composite yarn in accordance with the present invention includes the steps of forwarding the elastic member through an air jet and, while within the air jet, covering the elastic member with each of the conductive covering filament(s) and each of the inelastic synthetic polymer yarn(s) (if the same are provided). Thereafter the elastic member is allowed to relax.

It also lies within the contemplation of the present invention to provide a knit, woven or nonwoven fabric substantially wholly constructed from electrically conducting elastic composite yarns of the present invention. Such fabrics may be used to form a wearable garment or other fabric articles substantially.

BRIEF DESCRIPTION OF THE DRAWINGS

The invention will be more fully understood from the following detailed description, taken in connection with the accompanying drawings, which form a part of this application and in which:

FIG. 1*a* is a scanning electron micrograph (SEM) representation of a Prior Art electrically conducting metallic wire with a polymeric electrically insulating outer coating, while FIG. 1*b* is a scanning electron micrograph (SEM) representation of the electrically conducting wire of FIG. 1*a* after stress-induced elongation to break;

FIG. 3*a* is a scanning electron micrograph (SEM) representation of an electrically conducting elastic composite yarn in accordance with Invention Example 1 in a relaxed condition, while

FIG. 3*c* is a scanning electron micrograph (SEM) representation of an electrically conducting elastic composite yarn in accordance with Invention Example 2 of the present invention in a relaxed condition, while

FIG. 4 is a stress-strain curve for the electrically conducting elastic composite yarn of Invention Example 1 determined using Test Method 1, while

FIG. 7*a* is a scanning electron micrograph (SEM) representation of an electrically conducting elastic composite yarn (70) in accordance with Invention Example 3 in a relaxed condition, while

FIG. 7*c* is a scanning electron micrograph (SEM) representation of an electrically conducting elastic composite yarn in accordance with Invention Example 4 in a relaxed condition, while

FIG. 10*a* is a scanning electron micrograph (SEM) representation of an electrically conducting elastic composite yarn (90) in accordance with Invention Example 5 in a relaxed condition, while

FIG. 12*a* is a scanning electron micrograph (SEM) representation of a fabric made from the electrically conducting elastic composite yarn in accordance with Invention Example 6, the fabric being in a relaxed condition, while

FIG. 13*a* is a scanning electron micrograph (SEM) representation of a fabric from the electrically conducting elastic composite yarn of Invention Example 7, the fabric being in a relaxed condition, while

DETAILED DESCRIPTION OF THE INVENTION

Figure 2:
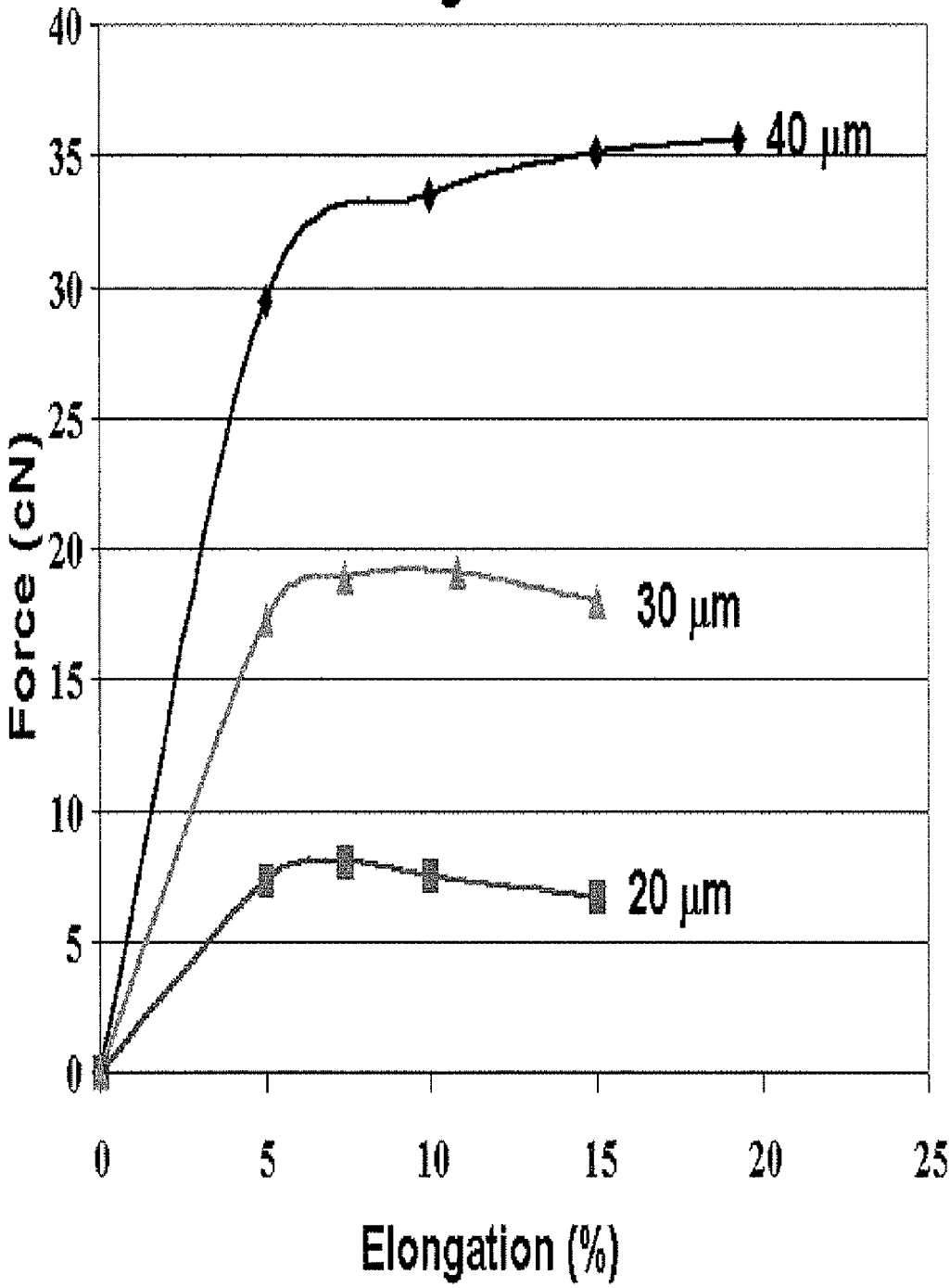
FIG. 2 is a stress-strain curve for three electrically conducting wires of the Prior Art wherein each electrically conductive wire has a different diameter.

In accordance with the present invention it has been found that it is possible to produce an electrically conductive elastic composite yarn containing metal wires, whether or not the wires are insulated with polymeric coatings. The electrically conducting elastic composite yarn according to the present invention comprises an elastic member (or "elastic core") that is surrounded by at least one conductive covering filament(s). The elastic member has a predetermined relaxed unit length L and a predetermined drafted length of (N×L), where N is a number, preferably in the range from about 1.0 to about 8.0, representing the draft applied to the elastic member.

The conductive covering filament has a length that is greater than the drafted length of the elastic member such that substantially all of an elongating stress imposed on the composite yarn is carried by the elastic member.

The elastic composite yarn may further include an optional stress-bearing member surrounding the elastic member and the conductive covering filament. The stress-bearing member is preferably formed from one or more inelastic synthetic polymer yarn(s). The length of the stress-bearing member(s) is less than the length of the conductive covering filament such that a portion of the elongating stress imposed on the composite yarn is carried by the stress-bearing member(s).

The Elastic Member The elastic member may be implemented using one or a plurality (i.e., two or more) filaments of an elastic yarn, such as that spandex material sold by DuPont Textiles and Interiors (Wilmington, Del., USA, 19880) under the trademark LYCRA®.

The drafted length (N×L) of the elastic member is defined to be that length to which the elastic member may be stretched and return to within five per cent (5%) of its relaxed (stress free) unit length L. More generally, the draft N applied to the elastic member is dependent upon the chemical and physical properties of the polymer comprising the elastic member and the covering and textile process used. In the covering process for elastic members made from spandex yarns a draft of typically between 1.0 and 8.0 and most preferably about 1.2 to about 5.0.

Alternatively, synthetic bicomponent multifilament textile yarns may also be used to form the elastic member. The synthetic bicomponent filament component polymers are thermoplastic, more preferably the synthetic bicomponent filaments are melt spun, and most preferably the component polymers are selected from the group consisting of polyamides and polyesters.

A preferred class of polyamide bicomponent multifilament textile yarns is those nylon bicomponent yarns which are self-crimping, also called "self-texturing". These bicomponent yarns comprise a component of nylon 66 polymer or copolyamide having a first relative viscosity and a component of nylon 66 polymer or copolyamide having a second relative viscosity, wherein both components of polymer or copolyamide are in a side-by-side relationship as viewed in the cross section of the individual filament. Self-crimping nylon yarn such as that yarn sold by DuPont Textiles and Interiors under the trademark TACTEL® T-800™ is an especially useful bicomponent elastic yarn.

The preferred polyester component polymers include polyethylene terephthalate, polytrimethylene terephthalate and polytetrabutylene terephthalate. The more preferred polyester bicomponent filaments comprise a component of PET polymer and a component of PTT polymer, both components of the filament are in a side-by-side relationship as viewed in the cross section of the individual filament. An especially advantageous filament yarn meeting this description is that yarn sold by DuPont Textiles and Interiors under the trademark T-400™ Next Generation Fiber. The covering process for elastic members from these bicomponent yarns involves the use of less draft than with spandex.

Typically, the draft for both polyamide or polyester bicomponent multifilament textile yarns is between 1.0 and 5.0.

The conductive covering filament In its most basic form the conductive covering filament comprises one or a plurality (i.e., two or more) strand(s) of metallic wire. These wire(s) may be uninsulated or insulated with a suitable electrically nonconducting polymer, e.g. nylon, polyurethane, polyester, polyethylene, polytetrafluoroethylene and the like. Suitable Insulated and uninsulated wires (with diameter on the order of 0.02 mm to 0.35 mm) are available from; but not limited to: N V Bekaert S A, Kortrijk, Belgium; Elektro-Feindraht A G, Escholzmatt, Switzerland and New England Wire Technologies Corporation, Lisbon, N.H. The metallic wire may be made of metal or metal alloys such as copper, silver plated copper, aluminum, or stainless steel.

In an alternative form, the conductive covering filament comprises a synthetic polymer yarn having one or more metallic wire(s) thereon or an electrically conductive covering, coating or polymer additive or sheath/core structure having a conductive core portion. One such suitable yarn is X-static® available from Laird Sauquoit Technologies, Inc. (300 Palm Street, Scranton, Pa., 18505) under the trademark X-static® yarn. One suitable form of X-static® yarn is based upon a 70 denier (77 dtex), 34 filament textured nylon available from DuPont Textiles and Interiors, Wilmington, Del. as product ID 70-XS-34X2 TEX 5Z electroplated with electrically conductive silver. Another suitable conductive yarn is a metal coated KEVLAR® yarn known as ARACON® from E. I. DuPont de Nemours, Inc., Wilmington, Del. Other conductive fibers which can serve as conductive covering filaments, include polypyrrole and polyaniline coated filaments which are known in the art; see for example: U.S. Pat. No. 6,360,315B1 to E. Smela. Combinations of conductive covering yarn forms are useful depending upon the application and are within the scope of the invention.

Suitable synthetic polymer nonconducting yarns are selected from among continuous filament nylon yarns (e.g. from synthetic nylon polymers commonly designated as N66, N6, N610, N612, N7, N9), continuous filament polyester yarns (e.g. from synthetic polyester polymers commonly designated as PET, 3GT, 4GT, 2GN, 3GN, 4GN), staple nylon yarns, or staple polyester yarns. Such composite conductive yarn may be formed by conventional yarn spinning techniques to produce composite yarns, such as plied, spun or textured yarns.

Whatever form chosen the length of the conducting conductive covering filament surrounding the elastic member is determined according to the elastic limit of the elastic member. Thus, the conductive covering filament surrounding a relaxed unit length L of the elastic member has a total unit length given by A(N×L), where A is some real number greater than one (1) and N is a number in the range of about 1.0 to about 8.0. Thus the conductive covering filament has a length that is greater than the drafted length of the elastic member.

The alternative form of the conductive covering filament may be made by surrounding the synthetic polymer yarn with multiple turns of a metallic wire.

Optional stress-bearing member The optional stress-bearing member of the electrically conductive elastic composite yarn of the present invention may be made from nonconducting inelastic synthetic polymer fiber(s) or from natural textile fibers like cotton, wool, silk and linen. These synthetic polymer fibers may be continuous filament or staple yarns selected from multifilament flat yarns, partially oriented yarns, textured yarns, bicomponent yarns selected from nylon, polyester or filament yarn blends.

If utilized, the stress-bearing member surrounding the elastic member is chosen to have a total unit length of B(N×L), where B is some real number greater than one (1). The choice of the numbers A and B determines the relative lengths of the conductive covering filament and any stress-bearing member. Where A>B, for example, it is ensured that the conducting covering filament is not stressed or significantly extended near its breaking elongation. Furthermore, such a choice of A and B ensures that the stress-bearing member becomes the strength member of the composite yarn and will carry substantially all the elongating stress of the extension load at the elastic limit of the elastic member. Thus, the stress-bearing member has a total length less than the length of the conductive covering filament such that a portion of the elongating stress imposed on the composite yarn is carried by the stress-bearing member. The length of the stress-bearing member should be greater than, or equal to, the drafted length (N×L) of the elastic member.

The stress-bearing member is preferably nylon. Nylon yarns comprised of synthetic polyamide component polymers such as nylon 6, nylon 66, nylon 46, nylon 7, nylon 9, nylon 10, nylon 11, nylon 610, nylon 612, nylon 12 and mixtures and copolyamides thereof are preferred. In the case of copolyamides, especially preferred are those including nylon 66 with up to 40 mole per cent of a polyadipamide wherein the aliphatic diamine component is selected from the group of diamines available from E. I. Du Pont de Nemours and Company, Inc. (Wilmington, Del., USA, 19880) under the respective trademarks DYTEK A® and DYTEK EP®.

Making the stress-bearing member from nylon renders the composite yarn dyeable using conventional dyes and processes for coloration of textile nylon yarns and traditional nylon covered spandex yarns.

If the stress-bearing member is polyester the preferred polyester is either polyethylene terephthalate (2GT, a.k.a. PET), polytrimethylene terephthalate (3GT, a.k.a. PTT) or polytetrabutylene terephthalate (4GT). Making the stress-bearing member from polyester multifilament yarns also permits ease of dyeing and handling in traditional textile processes.

The conductive covering filament and the optional stress-bearing member surround the elastic member in a substantially helical fashion along the axis thereof.

The relative amounts of the conductive covering filament and the stress-bearing member (if used) are selected according to ability of the elastic member to extend and return substantially to its unstretched length (that is, undeformed by the extension) and on the electrical properties of the conductive covering filament. As used herein "undeformed" means that the elastic member returns to within about +/− five per cent (5%) of its relaxed (stress free) unit length L.

It has been found that any of the traditional textile process for single covering, double covering, air jet covering, entangling, twisting or wrapping of elastic filaments with conductive filament and the optional stress-bearing member yarns is suitable for making the electrically conducting elastic composite yarn according to the invention.

In most cases, the order in which the elastic member is surrounded by the conductive covering filament and the optional stress-bearing member is immaterial for obtaining an elastic composite yarn. A desirable characteristic of these electrically conducting elastic composite yarns of this construction is their stress-strain behavior. For example, under the stress of an elongating applied force the conductive covering filament of the composite yarn, disposed about the elastic member in multiple wraps [typically from one turn (a single wrap) to about 10,000 turns], is free to extend without strain due to the external stress.

Similarly, the stress-bearing member, when also disposed about the elastic member in multiple wraps, again, typically from one turn (a single wrap) to about 10,000 turns, is free to extend. If the composite yarn is stretched near to the break extension of the elastic member, the stress-bearing member is available to take a portion of the load and effectively preserve the elastic member and the conductive covering filament from breaking. The term "portion of the load" is used herein to mean any amount from 1 to 99 per cent of the load, and more preferably 10% to 80% of the load; and most preferably 25% to 50% of the load.

Figure 14:
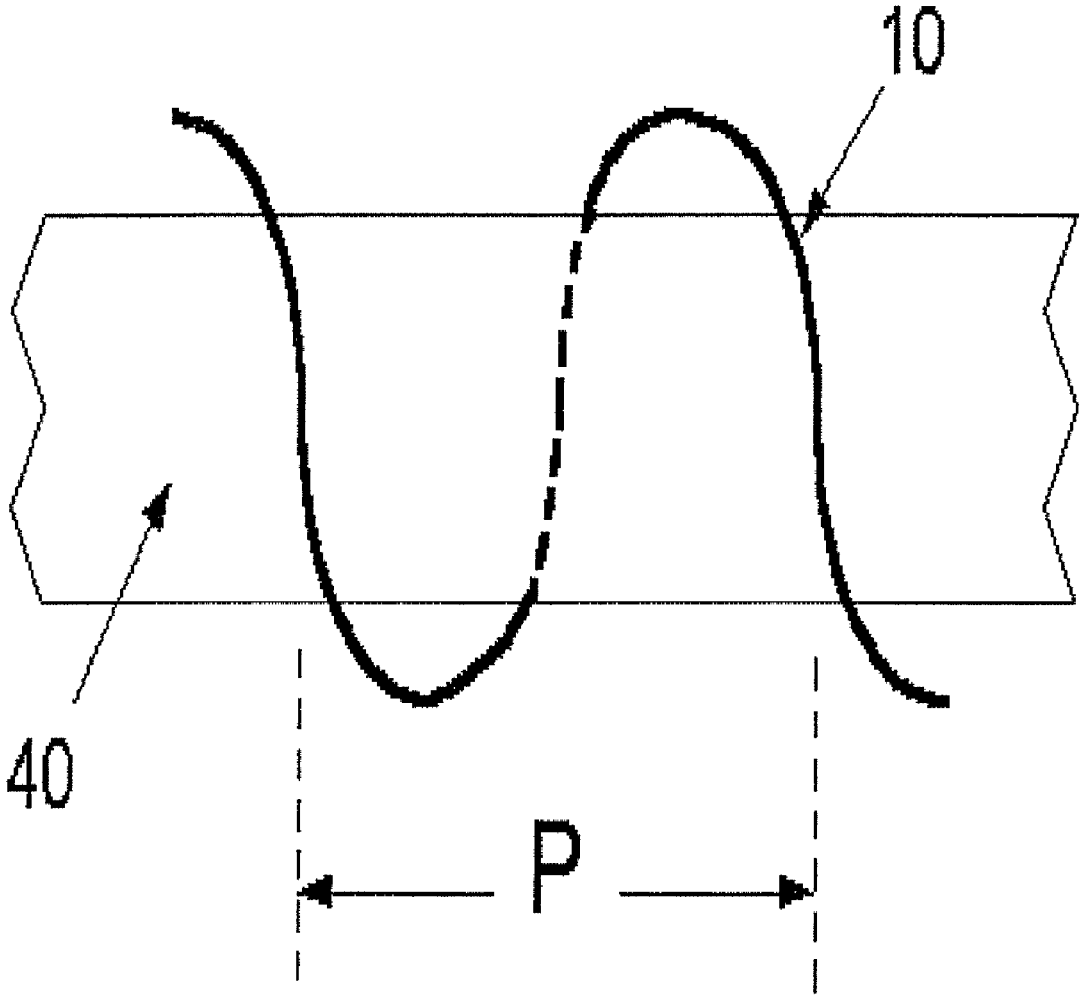
FIG. 14 is a schematic representation of an elastic member sinuously wrapped with a conductive filament.

The elastic member may optionally be sinuously wrapped by the conductive covering filament and the optional stress-bearing member. Sinuous wrapping is schematically represented in FIG. 14, where an elastic member (40), e.g. a LYCRA® yarn, is wrapped with a conductive covering filament (10), e.g. a metallic wire, in such a way that the wraps are characterized by a sinuous period (P).

Specific embodiments and procedures of the present invention will now be described further, by way of example, as follows.

Test Methods

Measurement of Fiber and Yarn Stress-Strain Properties Fiber and Yarn Stress-Strain Properties were determined using a dynamometer at a constant rate of extension to the point of rupture. The dynamometer used was that manufactured by Instron Corp, 100 Royall Street, Canton, Mass., 02021 USA.

The specimens were conditioned to 22° C.±1° C. and 60%±5% R.H. The test was performed at a gauge length of 5 cm and crosshead speed of 50 cm/min. For metal wires and bare elastic yarns, threads measuring about 20 cm were removed from the bobbin and let relax on a velvet board for at least 16 hours in air-conditioned laboratory. A specimen of this yarn was placed in the jaws with a pre-tension weight corresponding to the yarn dtex so as not to give either tension or slack.

For the conductive composite yarns of the invention, test specimens were prepared under two different methods as follows:

(Method 1) Specimen prepared as in the case of bare fibers (relaxed state)

(Method 2) Specimen prepared by taking the yarn directly from the bobbin.

The results obtained from the two methods enable direct comparison between the electrically conductive elastic composite yarn and its components (Method 1), as well as, assuring intact positioning of the electrically conductive elastic composite yarn during the measurement (variation between Methods 1 & 2). In addition tests were performed under varied pretension load that sets the yarn relaxed length. In this case the range of pretension loads applied simulates:

(i) the pretension appropriate for the elastic component of the electrically conductive elastic composite yarn so as not to give either tension or slack; these results can then be in direct comparison with the results obtained from the individual components of the electrically conductive elastic composite yarn, and (ii) the tension load applied on the yarn during knitting or weaving processes; these results are then a representation of the processability of the yarn as well as the influence of the conductive composite yarn on the elastic performance of the knitted or woven fabric based on this yarn. It is expected that the pretension load influences available elongation of the yarn (at a higher pretension load a lower available elongation is measured) but not the ultimate strength of the yarn.

Measurement of Fabric Stretch Fabric stretch and recovery for a stretch woven fabric is determined using a universal electromechanical test and data acquisition system to perform a constant rate of extension tensile test. A suitable electromechanical test and data acquisition system is available from Instron Corp, 100 Royall Street, Canton, Mass., 02021 USA.

Two fabric properties are measured using this instrument: fabric stretch and the fabric growth (deformation). The available fabric stretch is the amount of elongation caused by a specific load between 0 and 30 Newtons and expressed as a percentage change in length of the original fabric specimen as it is stretched at a rate of 300 mm per minute. The fabric growth is the unrecovered length of a fabric specimen which has been held at 80% of available fabric stretch for 30 minutes then allowed to relax for 60 minutes. Where 80% of available fabric stretch is greater than 35% of the fabric elongation, this test is limited to 35% elongation. The fabric growth is then expressed as a percentage of the original length.

The elongation or maximum stretch of stretch woven fabrics in the stretch direction is determined using a three-cycle test procedure. The maximum elongation measured is the ratio of the maximum extension of the test specimen to the initial sample length found in the third test cycle at load of 30 Newtons. This third cycle value corresponds to hand elongation of the fabric specimen. This test was performed using the above-referenced universal electromechanical test and data acquisition system specifically equipped for this three-cycle test.

EXAMPLES

Parenthetical reference numerals present in the discussion of the Examples refer to the reference characters used in the appropriate drawing (s).

Comparative Example Electrically conducting wires having an electrically insulated polymer outer coating were examined for their stress and strain properties using the dynamometer and Method 1 for measuring individual components of the electrically conductive elastic composite yarn. Samples of three wires available from ELEKTRO-FEINDRAHT AG, Switzerland, were tested. The metallic portion of the wires is shown in FIGS. 1A and 1B. The first sample wire had a nominal diameter of 20 micrometers (μm), a second sample 30 μm, and a third sample 40 μm. The stress-strain curves of these three samples are shown in FIG. 2; using Test Method 1. These curves are typical of fine metallic wires. These wires exhibit a quite high modulus which along with the force to break increases with an increase in the wire diameter. All the wires break before elongation to 20% of their test specimen length, characterized by a quite low ultimate strength. Clearly, where metallic wires are used in textile fabrics and apparel there is a severe limit to the elongation available. Such wires in garments subject to stretch from movement of the wearer would be undependable conductors of electricity due to breakage of the wire.

Example 1 of the Invention (FIGS. 3*a*, 3*b*, 4, 5)

Figure 3A:
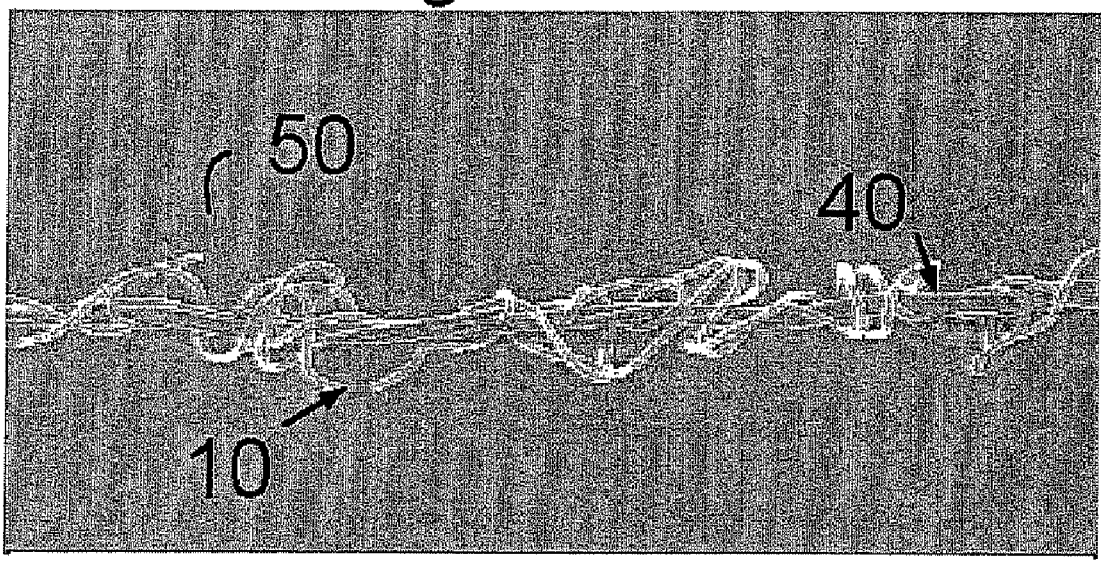
Figure 3B:
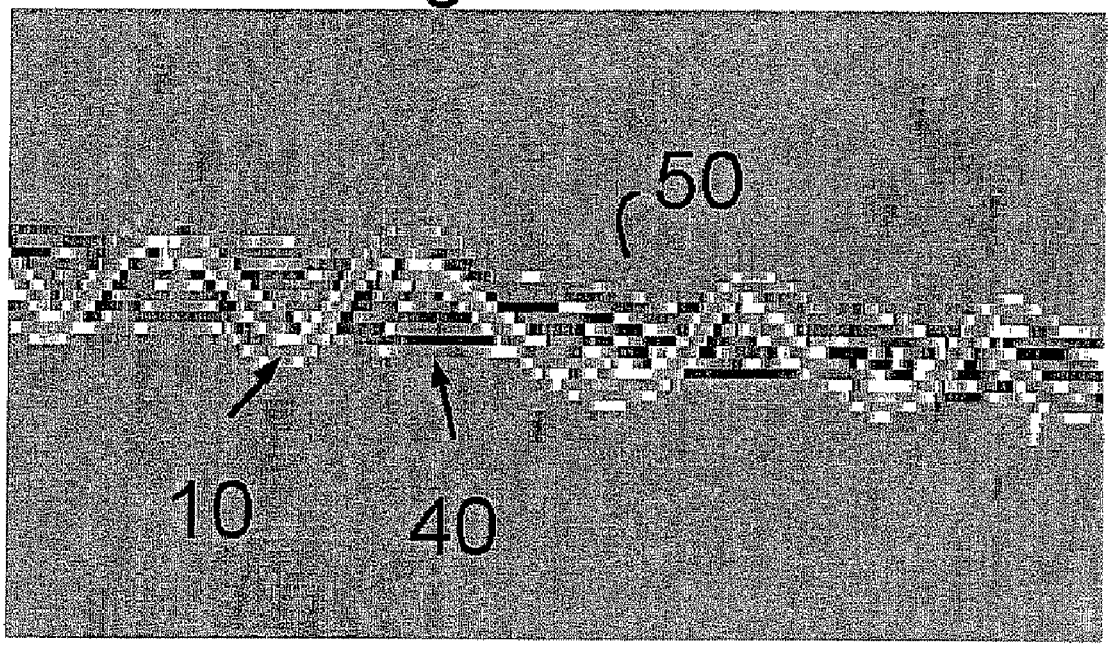
FIG. 3*b* is a scanning electron micrograph (SEM) representation of the electrically conducting elastic composite yarn of FIG. 3*a* in a stretched condition.
Figure 4:
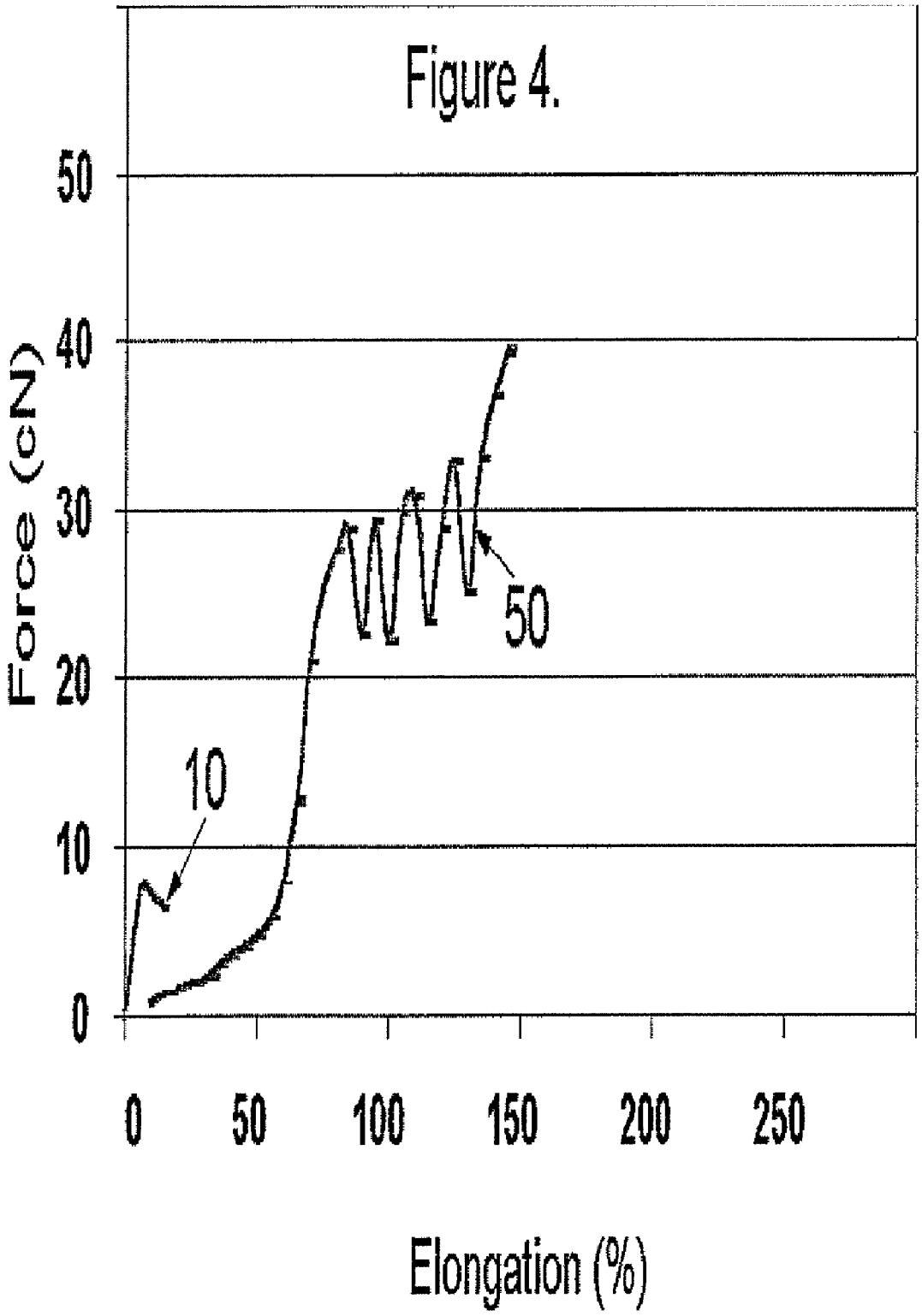
Figure 5:
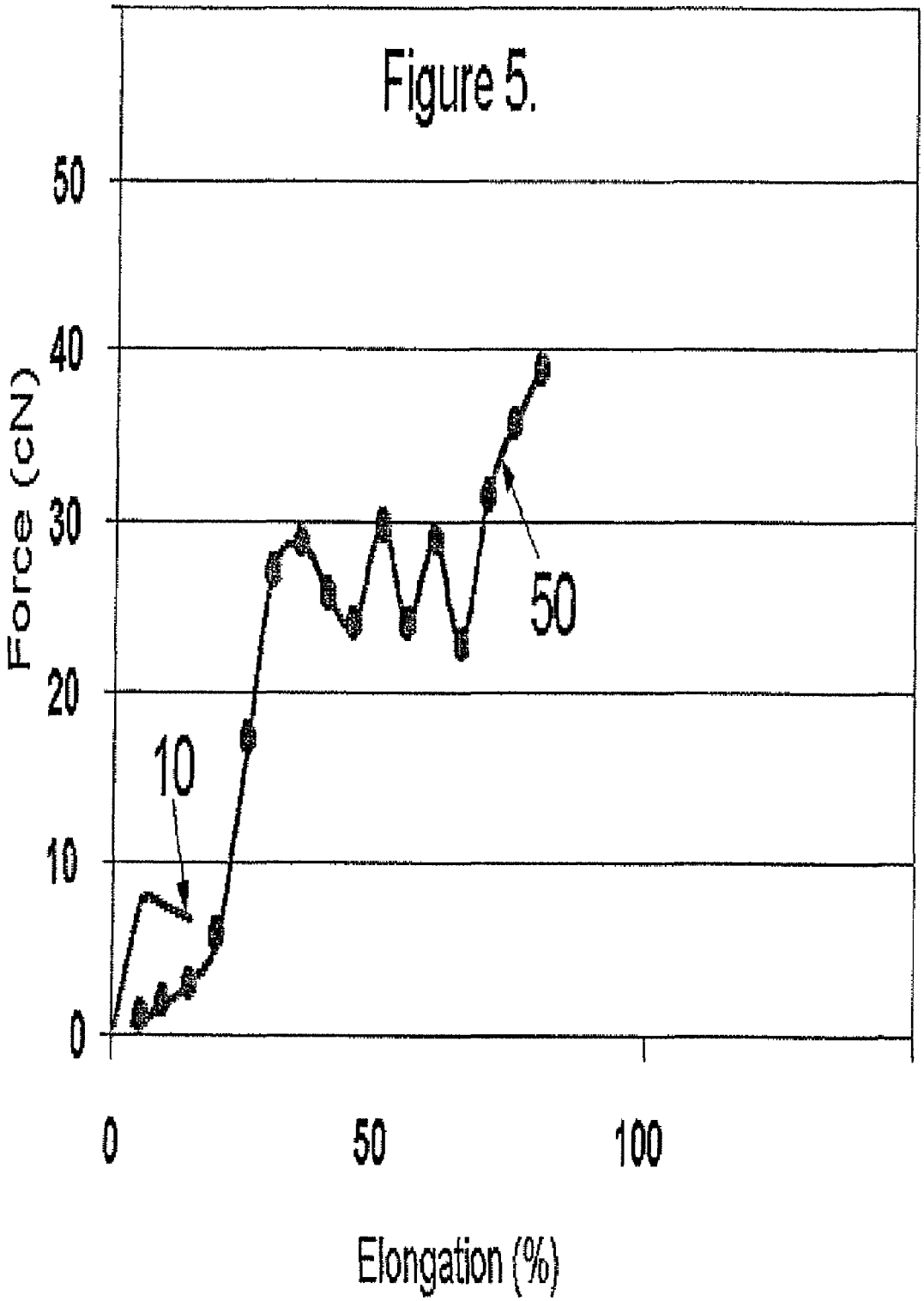
FIG. 5 is a stress-strain curve for the electrically conducting elastic composite yarn of Invention Example 1 determined using Test Method 2, and, in both FIGS. 4 and 5, for comparison, the stress-strain curve of metal wire alone.

A 44 decitex (dtex) elastic core (40) made of LYCRA® spandex yarn was wrapped with a 20 μm diameter insulated silver-copper metal wire (10) obtained from ELEKTRO-FEINDRAHT AG, Switzerland using a standard spandex covering process. Covering was done on an I.C.B.T. machine model G307. During this process LYCRA® spandex yarn was drafted to a value of 3.2 times (i.e. N=3.2) and was wrapped with two metal wires (10) of the same type, one twisted to the "S" and the other to the "Z" direction, to produce a electrically conductive elastic composite yarn (50). The wires (10) were wrapped at 1700 turns/meter (turns of wire per meter of drafted Lycra® spandex yarn) (5440 turns for each relaxed unit length L) for the first covering and at 1450 turns/meter (4640 turns for each relaxed unit length L) for the second covering. An SEM picture of this composite yarn is shown in the relaxed (FIG. 3*a*) and stretched states (FIG. 3*b*). The stress-strain curve shown in FIG. 4 is for electrically conductive elastic composite yarn (50) measured as in the comparative example using Test Method 1 with an applied pretension load of 100 mg. This electrically conductive elastic composite yarn (50) exhibits an exceptional stretch behavior to over 50% more than the test specimen length and elongates to the range of 80% before it breaks exhibiting a higher ultimate strength than the 20 μm wire individually. This process allows production of an electrically conductive elastic composite yarn (50) that exhibits an elongation to break in the range of 80% and a force to break in the range of 30 cN, compared to the individual metal wire that exhibits an elongation to break of only 7% and a force to break of only 8 cN. The stress-strain curve of this electrically conductive elastic composite yarn (50) was also measured according to Test Method 2 using a higher pretension load of 1 gram. This pretension more closely corresponds to that tension applied during a knitting process (FIG. 5). Under these conditions the elongation to break of the electrically conductive elastic composite yarn (50) is in the range of 35%. This elongation indicates that yarn (50) is easier handle in a textile process and will provide a stretch fabric compared to the individual metal wire yarn. As can be seen from the characteristic stress-strain curve of this example, the break of the electrically conductive elastic composite yarn (50) is caused by the metal wire breaking before the elastic member of the composite yarn (50) breaks.

Figure 3C:
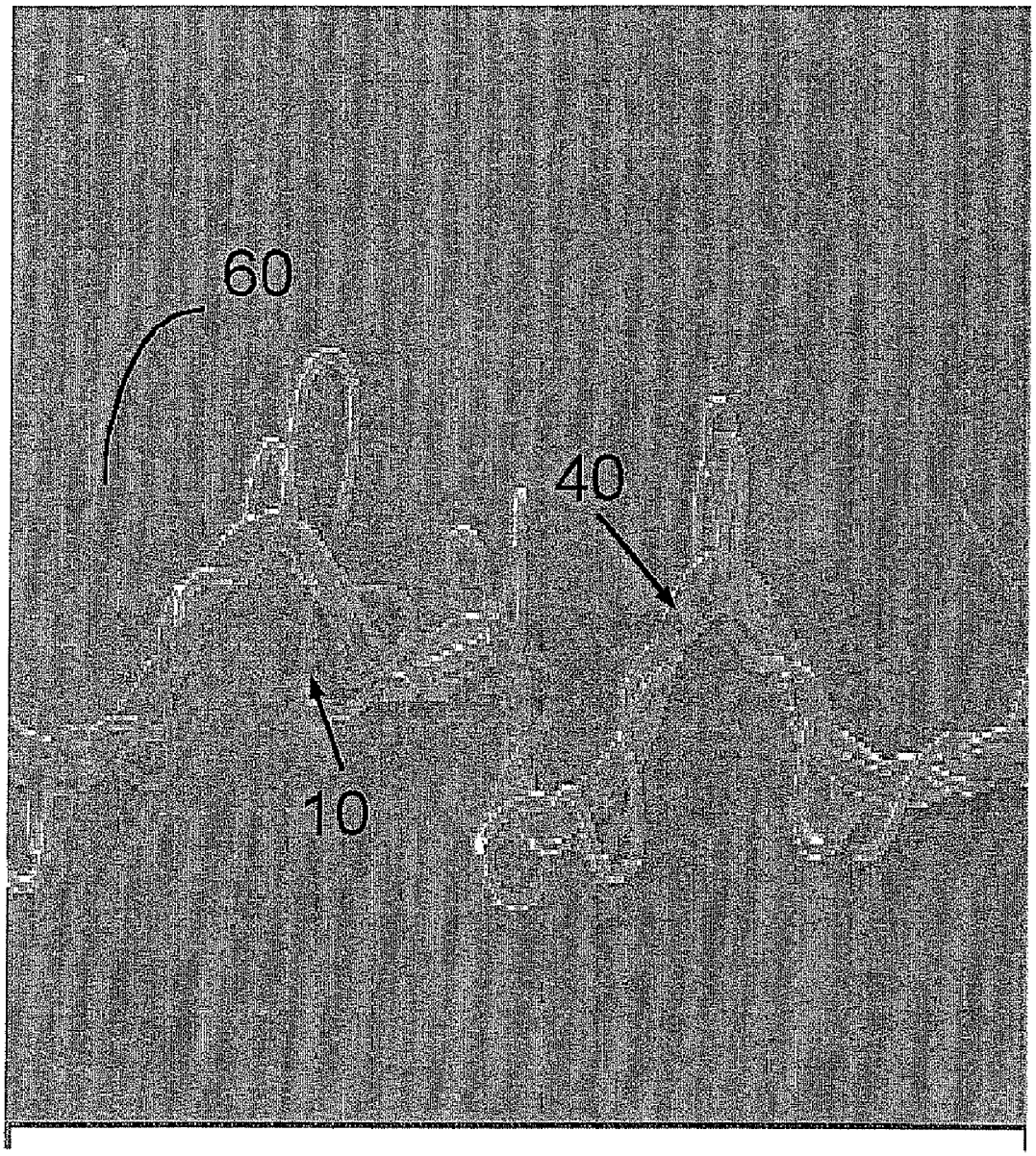
Figure 3D:
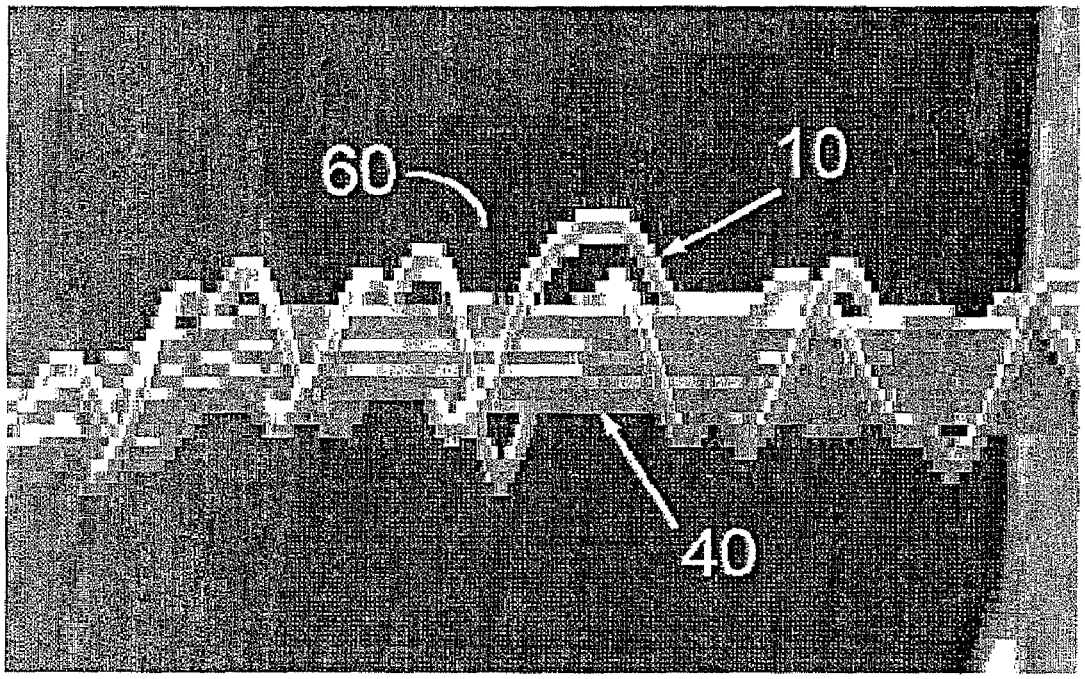
FIG. 3*d* is a scanning electron micrograph (SEM) representation of the electrically conducting elastic composite yarn of FIG. 3*c* in a stretched condition.
Figure 6:
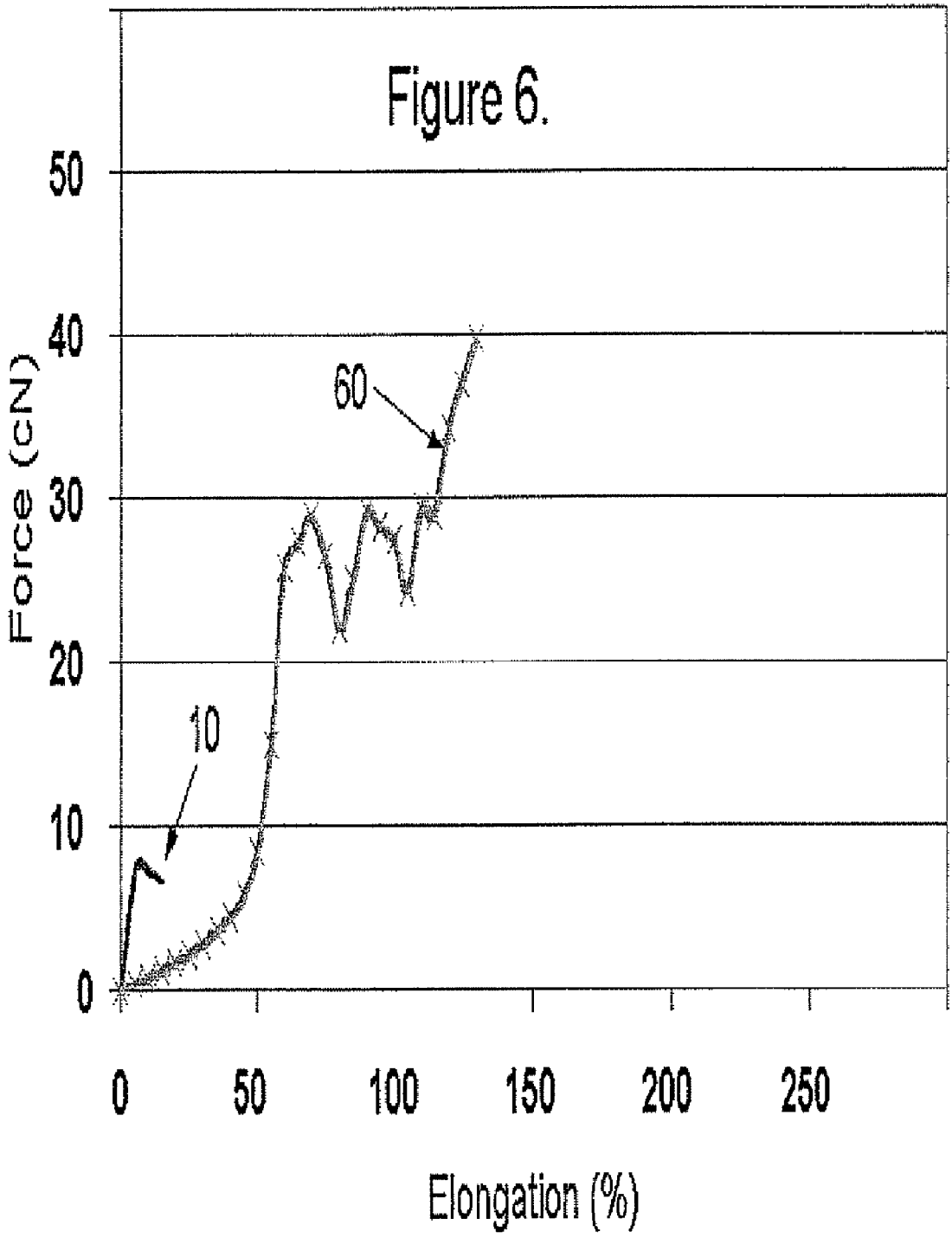
FIG. 6 is a stress-strain curve for the electrically conducting elastic composite yarn of Invention Example 2 of the invention determined using Test Method 1, and, for comparison, the stress-strain curve of metal wire alone.

Example 2 of the Invention (FIGS. 3*c*, 3*d*, 6)

An electrically conducting elastic composite yarn (60) according to the invention was produced under the same conditions as in Example 1 except that the metal wires (10) were wrapped at 2200 turns/meter (7040 turns for each relaxed unit length L) and at 1870 turns/meter (5984 turns for each relaxed unit length L) for the first and second coverings, respectively. An SEM picture of this electrically conductive elastic composite yarn (60) is shown in FIG. 3*c* (relaxed state) and FIG. 3*d* (stretched state). These Figures clearly show a higher covering of the elastic member (40) by the metal wires (10) in comparison with Example 1, The stress-strain curve of this electrically conductive elastic composite yarn (60) is shown in FIG. 6; measured as in the Comparative Example using Test Method 1 and an applied pretension load of 100 mg. This electrically conductive elastic composite yarn (60) exhibits a similar ultimate strength but lower available elongation compared to the electrically conductive elastic composite yarn of Example 1. This process allows production of an electrically conducting composite yarn exhibiting an elongation to break in the range of 40% and a force to break in the range of 30 cN, compared to the individual metal wires (10) that exhibit an elongation to break of only 7% and a force to break of only 8 cN. The same electrically conducting composite yarn tested under Method 2, but using a pretension load of 1 gram, showed a similar behavior to the electrically conducting composite yarn of Example 1 under the same test method indicating good handling during a textile process.

The results shown by Examples 1 and 2 of the invention indicate that electrically conductive elastic composite yarns can be produced by the double covering process at varying covering fractions of the elastic member which have exceptional stretch performance and higher strength compared to the individual metal wire.

This flexibility in construction of electrically conductive elastic composite yarn of the invention is both interesting and desirable for applications utilizing the electrical properties of such electrically conductive elastic composite yarns. For example, in wearable electronics, a magnetic field may be modulated or suppressed depending on the requirements of the application by varying the construction of the electrically conductive elastic composite yarn.

Figure 7A:
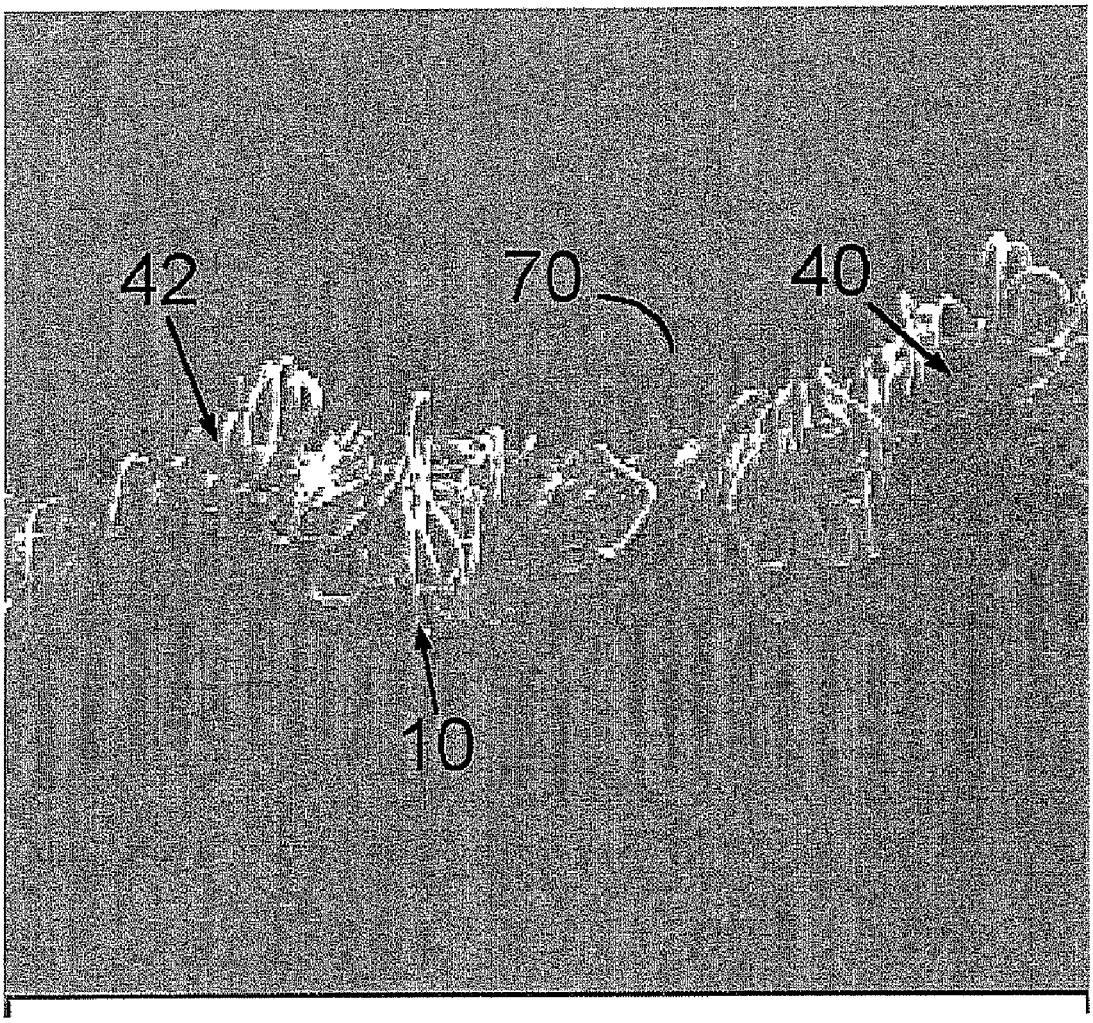
Figure 7B:
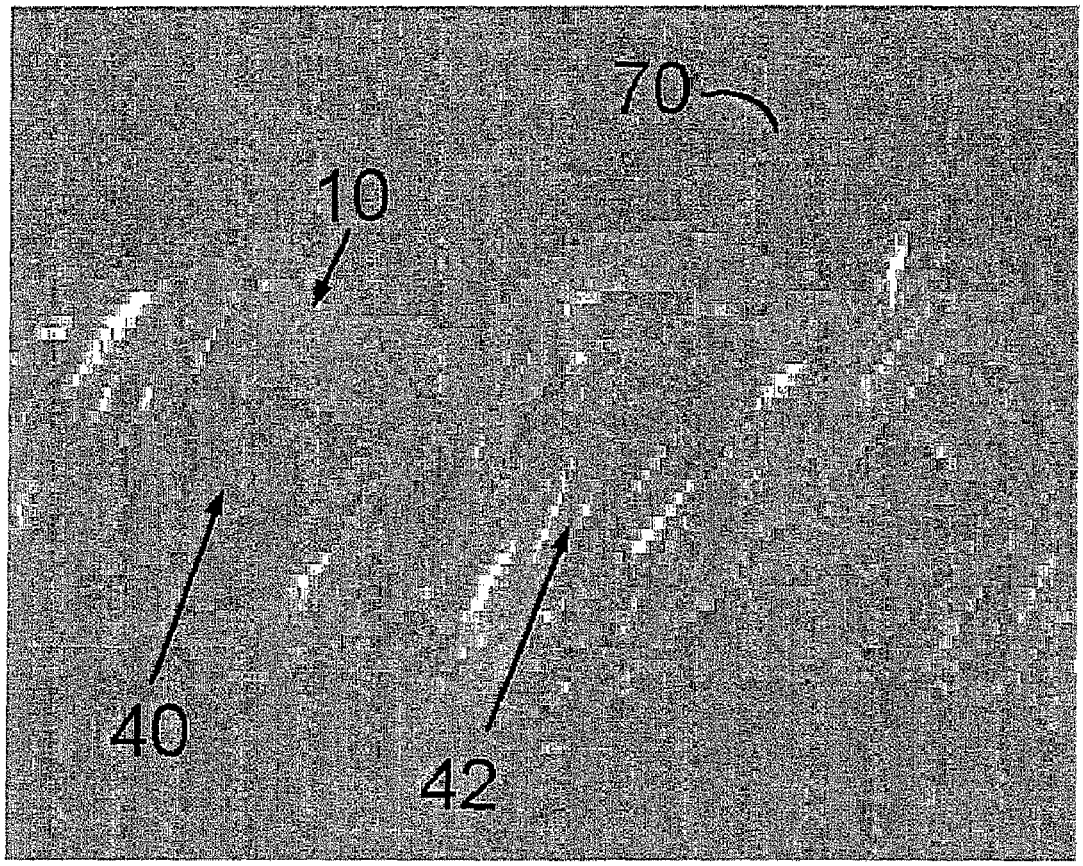
FIG. 7*b* is a scanning electron micrograph (SEM) representation of the electrically conducting elastic composite yarn of FIG. 7*a* in a stretched condition.
Figure 8:
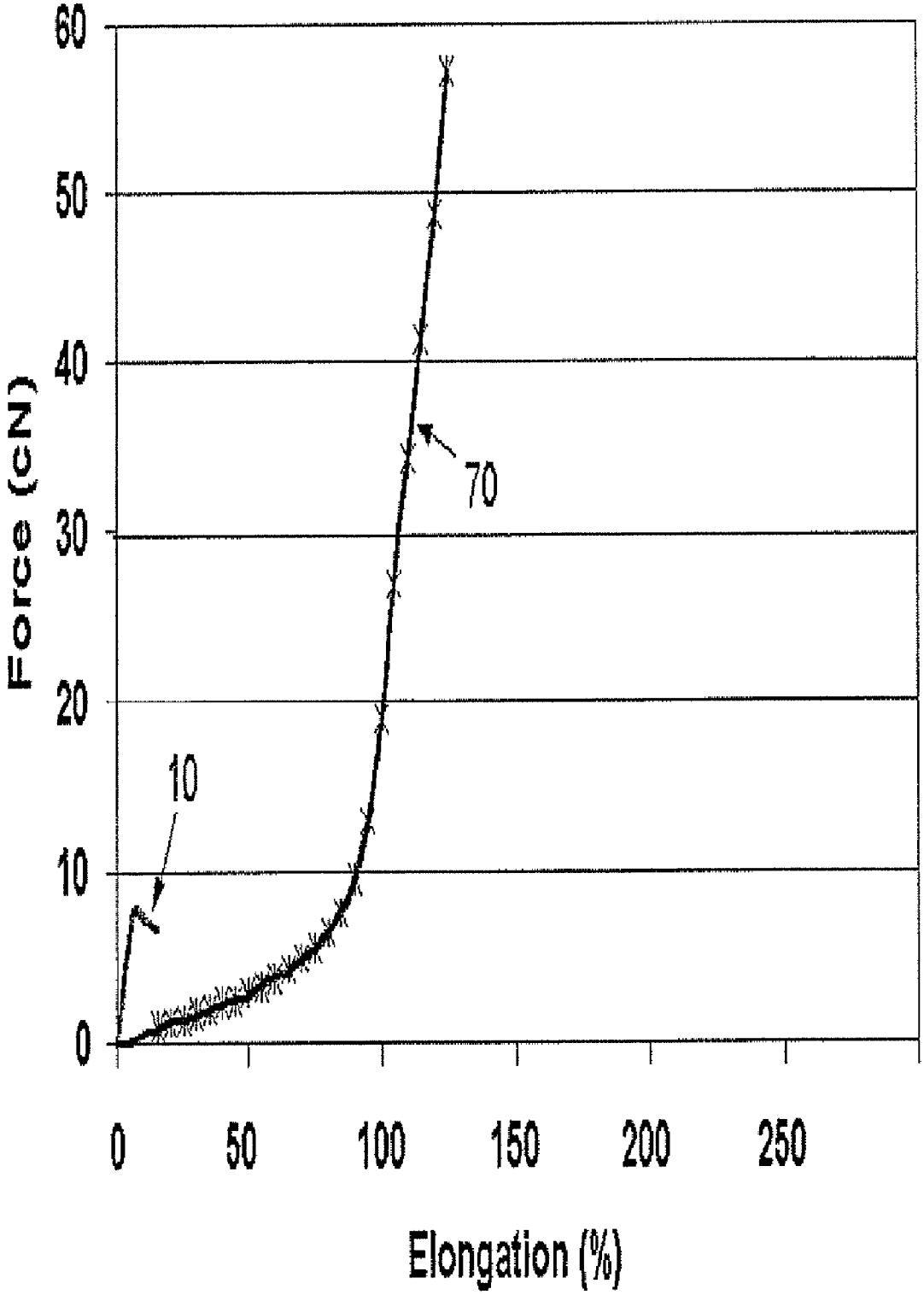
FIG. 8 is a stress-strain curve for the electrically conducting composite yarn of Invention Example 3 determined using Test Method 1, and, for comparison, the stress-strain curve of metal wire alone.

Example 3 of the Invention (FIGS. 7*a*, 7*b*, 8)

A 44 decitex (dtex) elastic core (40) made of LYCRA® spandex yarn as used in the Examples 1 and 2 of the invention was covered with a 20 μm nominal diameter insulated silver-copper metal wire (10) obtained from ELEKTRO-FEINDRAHT AG, Switzerland, and a with a 22 dtex 7 filament stress-bearing yarn of TACTEL® nylon (42) using the same covering process as in Example 1 of the invention. During this process the elastic member was drafted to a draft of 3.2 times and covered with 2200 turns/meter (7040 turns for each relaxed unit length L) of wire (10) per meter and 1870 turns/meter (5984 turns for each relaxed unit length L) of TACTEL® nylon (42) An SEM picture of this electrically conducting elastic composite yarn (70) is shown in the relaxed state (FIG. 7*a*) and stretched state (FIG. 7*b*). It is evident from this picture that such process provides a higher protection for the conductive covering filament (10) compared to Examples 1 and 2 of the invention.

This feature is desirable in applications where an insulation layer is sought for a metal wire or to provide protection of the wire (10) during textile processing. The incorporation of stress-bearing nylon yarn (42) also determines certain aesthetics. Hand and texture of the electrically conducting composite yarn (70) are determined primarily by the stress-bearing nylon yarn (42) comprising the outer layer of the electrically conductive elastic composite yarn (70). This is desirable for the overall aesthetics and touch of the garment.

The stress-strain curve of electrically conducting composite yarn (70) shown in FIG. 8 is measured as in the Comparative Example using Test Method 1 with an applied pretension load of 100 mg. This electrically conducting elastic composite yarn (70) elongates easily to over 80% using less force to elongate than the breaking stress of the 20 μm wire individually. This electrically conducting elastic composite yarn (70) exhibits an elongation to break in the range of 120% and an ultimate strength in the range of 120 cN which is significantly higher than the available elongation and strength of any metal wire sample tested in the Comparative Example. Tested under Method 2 and a pretension load of 1 gram, this yarn (70) shows a soft stretch in the range of 0-35% elongation, which indicates significant contribution of this yarn in the elastic performance of a garment made of this yarn. Incorporation of stress-bearing nylon yarn (42) in the electrically conducting elastic composite yarn (70) results in a significant increase of the ultimate strength as well as elongation of the electrically conducting composite yarn.

Figure 7C:
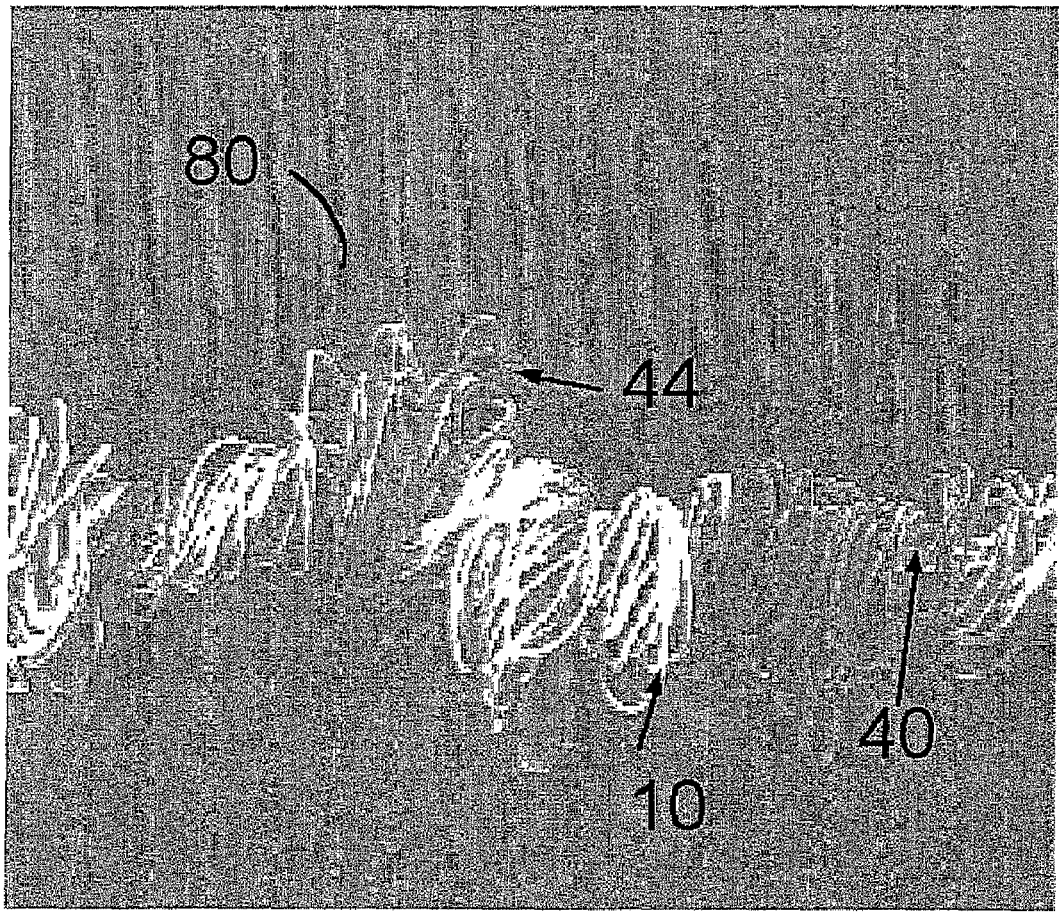
Figure 7D:
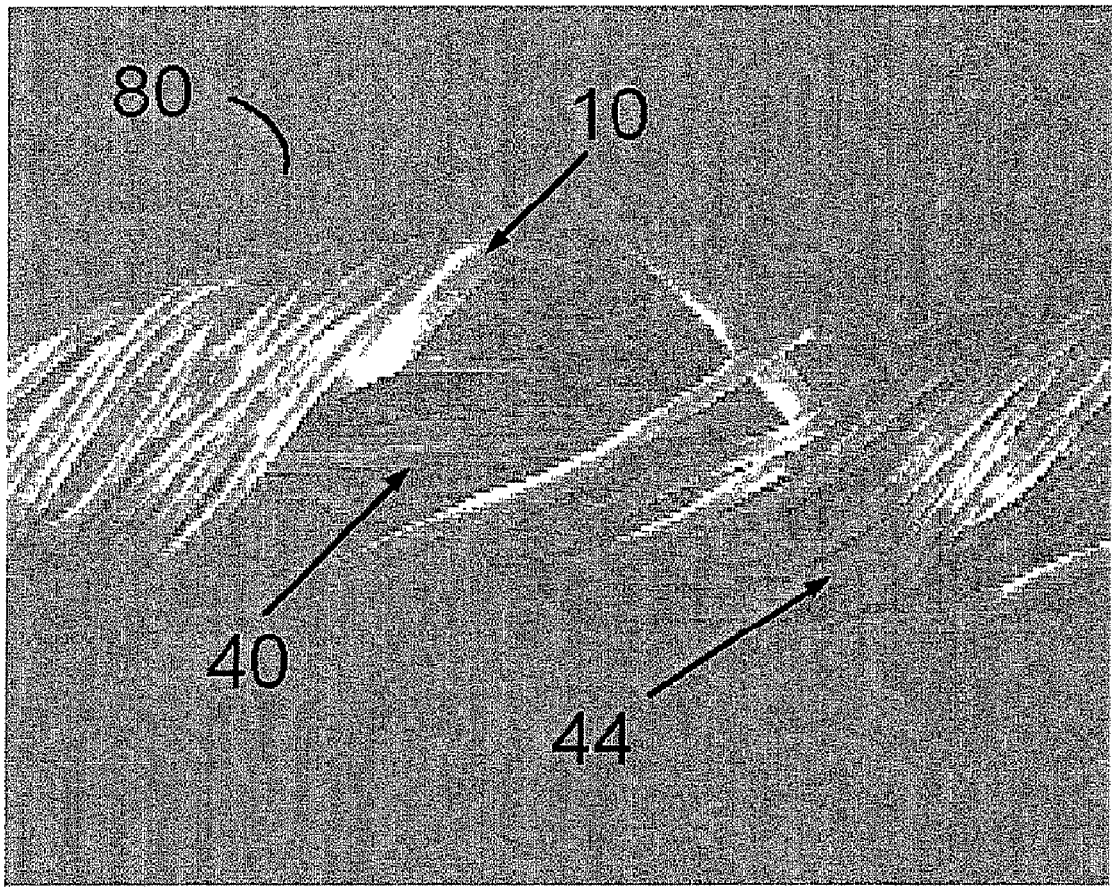
FIG. 7*d* is a scanning electron micrograph (SEM) representation of the electrically conducting elastic composite yarn of FIG. 7*c* in a stretched condition.
Figure 9:
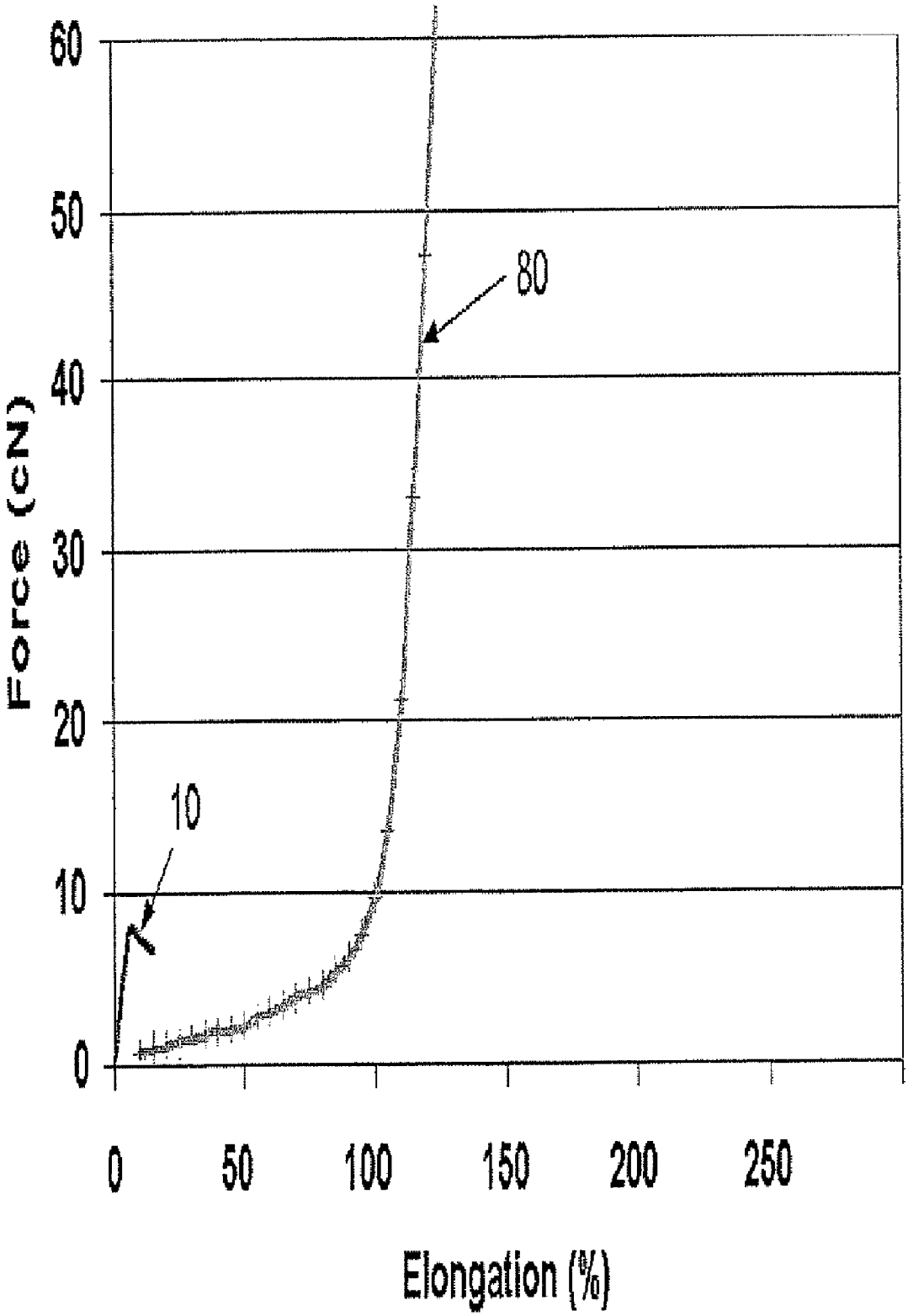
FIG. 9 is a stress-strain curve for the electrically conducting composite yarn of Invention Example 4 determined using Test Method 1, and, for comparison, the stress-strain curve of metal wire alone.

Example 4 of the Invention (FIGS. 7*c*, 7*d*, 9)

An electrically conducting elastic composite yarn (80) was produced under the same conditions of Example 3 of the invention, except for the following: the stress-bearing Tactel® nylon yarn (44) was a 44 dtex 34 filament microfiber. The first covering was 1500 turns/meter (4800 turns for each relaxed unit length L) of wire (10) and the second covering was 1280 turns/meter (4096 turns for each relaxed unit length L) of nylon fiber (44) of drafted elastic core (40). An SEM picture of this electrically conducting elastic composite yarn (80) is shown in the relaxed state (FIG. 7*c*) and stretched state (FIG. 7*c*). The bulkiness of this electrically conducting elastic composite yarn (80) provides for good protection of the metal wire (10) while taking on the soft aesthetics of a microfiber stress-bearing yarn (44). The stress-strain curve of this yarn (80) is shown in FIG. 9 as measured in the Comparative Example using Test Method 1 with an applied pretension load of 100 mg. This electrically conducting elastic composite yarn (80) elongates easily to over 80% using less force to elongate than the breaking stress of the 20 μm wire individually, and exhibits an elongation to break in the range of 120% and an ultimate strength in the range of 200 cN which is significantly higher than the available elongation and strength of any metal wire sample tested in the Comparative Example. Tested under Method 2 and a pretension load of 1 gram, electrically conducting elastic composite yarn (80) shows a soft stretch in the range of zero to 35% elongation. Such a result is indicative of the significant contribution in the elastic performance of a garment made from the yarn (80). Incorporation of a stronger stress-bearing nylon fiber (44) in the electrically conductive elastic composite yarn (80) compared with Example 3 of the invention results in a further enhancement of the ultimate strength of the electrically conductive elastic composite yarn (80).

Figure 10A:
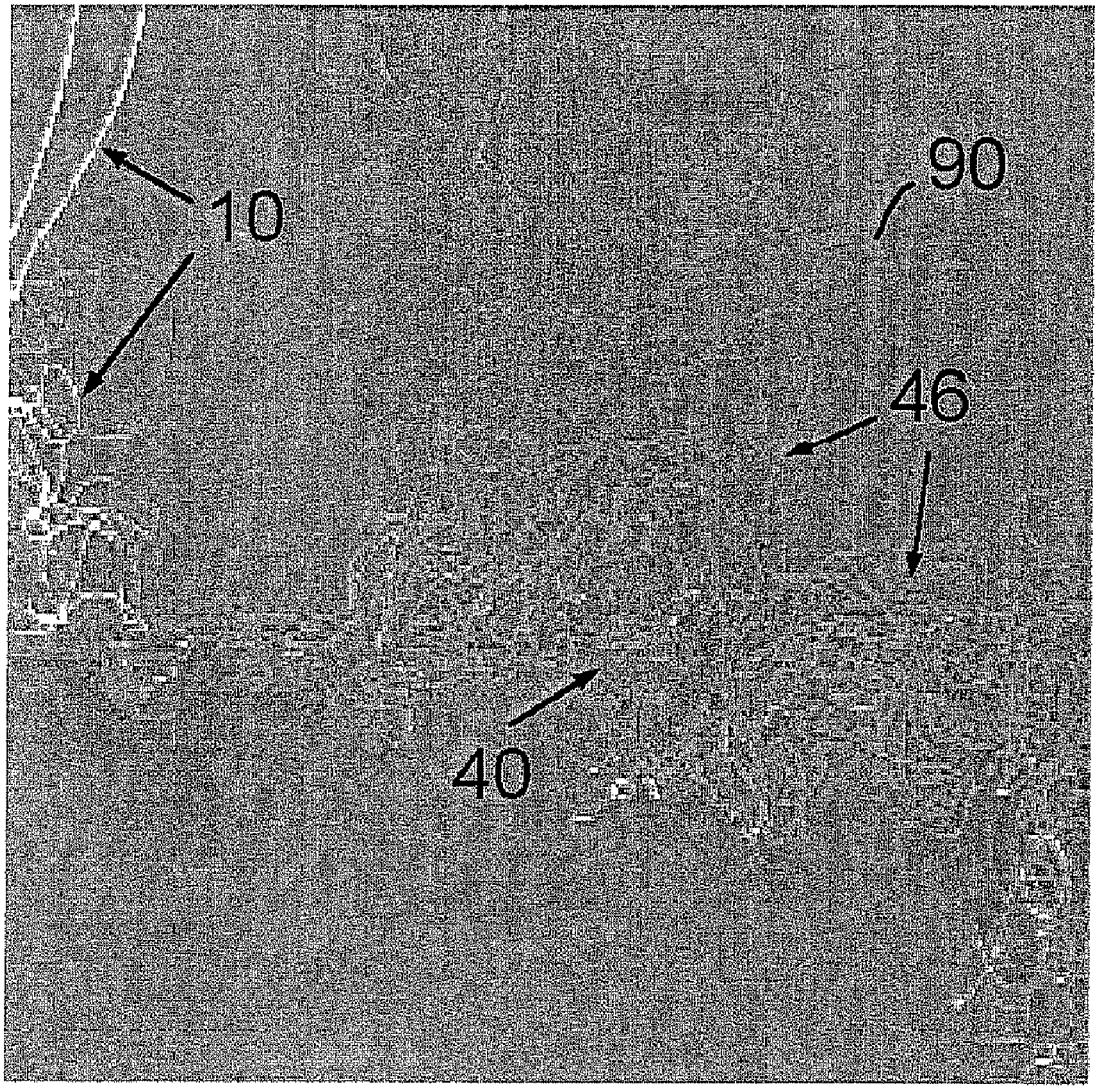
Figure 10B:
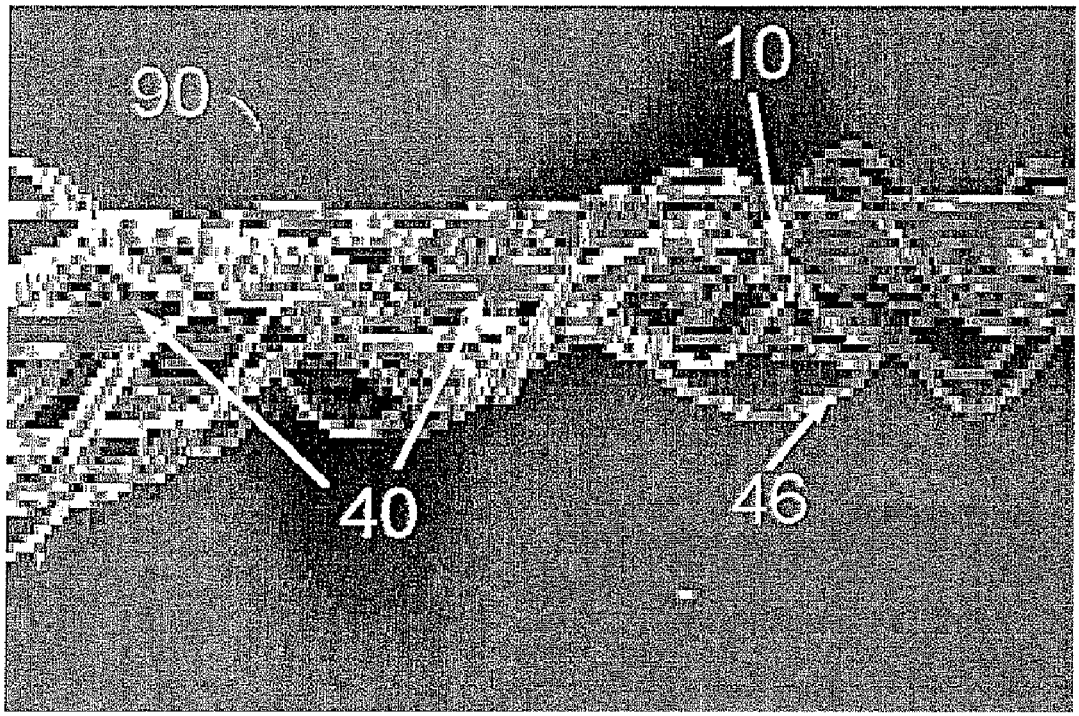
FIG. 10*b* is a scanning electron micrograph (SEM) representation of the yarn (90) of FIG. 10*a* in a stretched condition.
Figure 11:
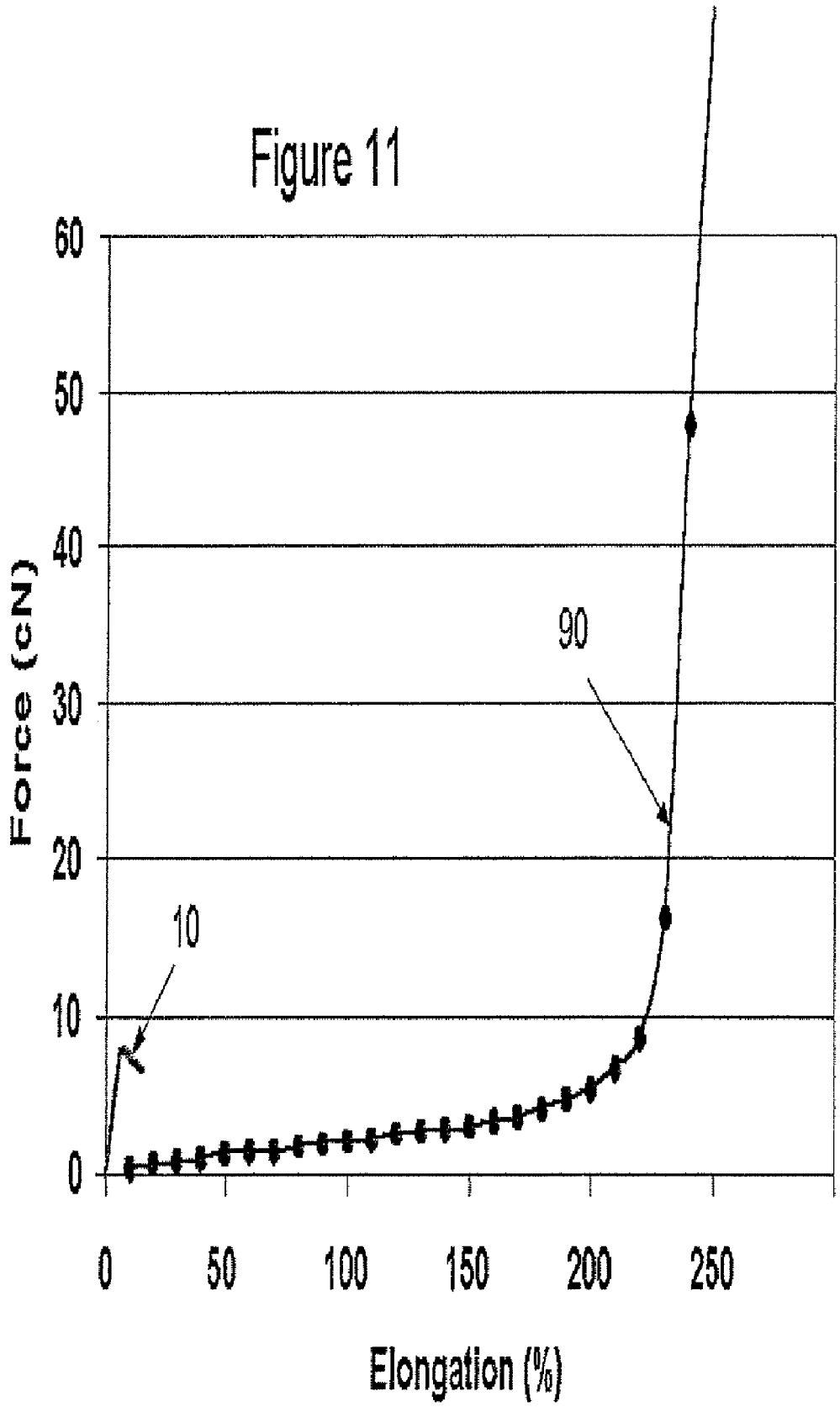
FIG. 11 is a stress-strain curve for the electrically conducting composite yarn of Example 5 determined using Test Method 1, and, for comparison, the stress-strain curve of metal wire alone.

Example 5 of the Invention (FIGS. 10*a*, 10*b*, 11)

A 44 decitex (dtex) elastic member (40) made of LYCRA® spandex yarn was covered with a stress-bearing 44 dtex 34 filament TACTEL® Nylon microfiber (46) and metal wire (10) via a standard air-jet covering process. This covering was made on an SSM (Scharer Schweiter Mettler AG) 10-position machine model DP2-C/S. An SEM picture of this electrically conducting composite yarn (90) is shown in the relaxed state (FIG. 10*a*) and stretched state (FIG. 10*b*). During this process the metallic wire (10) forms loops due to its monofilament nature. However in the stretched state the metallic wires (10) are completely protected by the stross-boaring nylon fiber (46). The structure provided by the air-jet covering process is not well-defined nor in a predetermined geometrical direction as in the simple covering processes of Examples 1-4 of this invention. The stress-strain curve of this yarn (90) is shown in FIG. 11 measured as in the Comparative Example using Test Method 1 with an applied pretension load of 100 mg. This electrically conductive elastic composite yarn (90) elongates easily to over 200% using less force to elongate than the breaking stress of the 20 μm wire individually, and exhibits an elongation to break in the range of 280% and an ultimate strength in the range of 200 cN. This elongation is significantly higher than the available elongation and strength of any metal wire sample tested in the Comparative Example. Tested under Method 2 and a pretension load of 1 gram, electrically conductive elastic composite yarn (90) shows a soft stretch in the range of 100% elongation. This indicates that a significant contribution in the elastic performance of a garment of the yarn (90) is expected. Incorporation of a stress-bearing nylon fiber (46) in the electrically conductive elastic composite yarn (90), via air-jet covering, results in a significant enhancement of the ultimate strength of the composite yarn (90) which is similar with the observations made on electrically conductive elastic composite yarn by the double-covering process (e.g. Examples 3 and 4 of the invention). Further, it is observed that the air-jet covering process allows for a still higher available elongation range when compared to the processes using the same draft of the LYCRA® elastic member (40) in Examples 3 and 4. This feature increases the range of possible elastic performance in garments made from such electrically conducting elastic composite yarn.

Figure 12A:
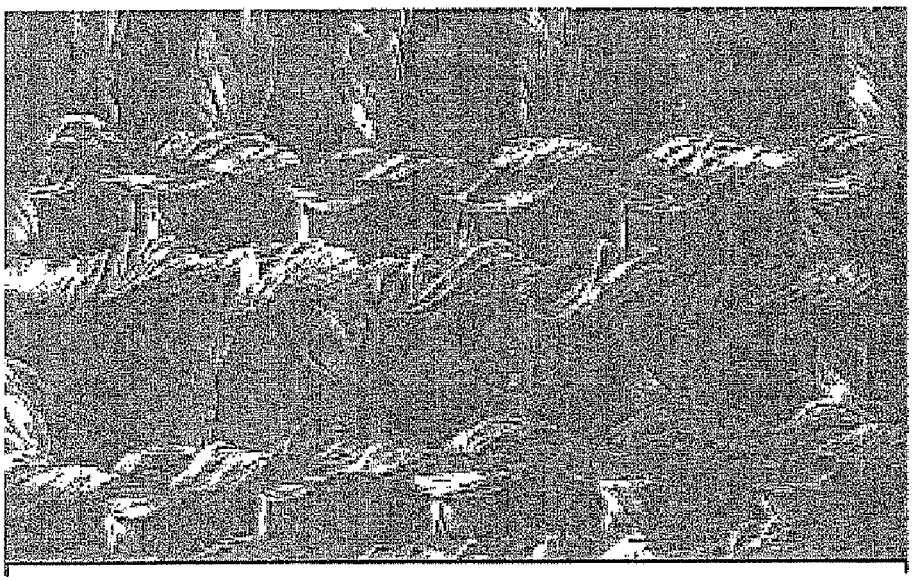
Figure 12B:
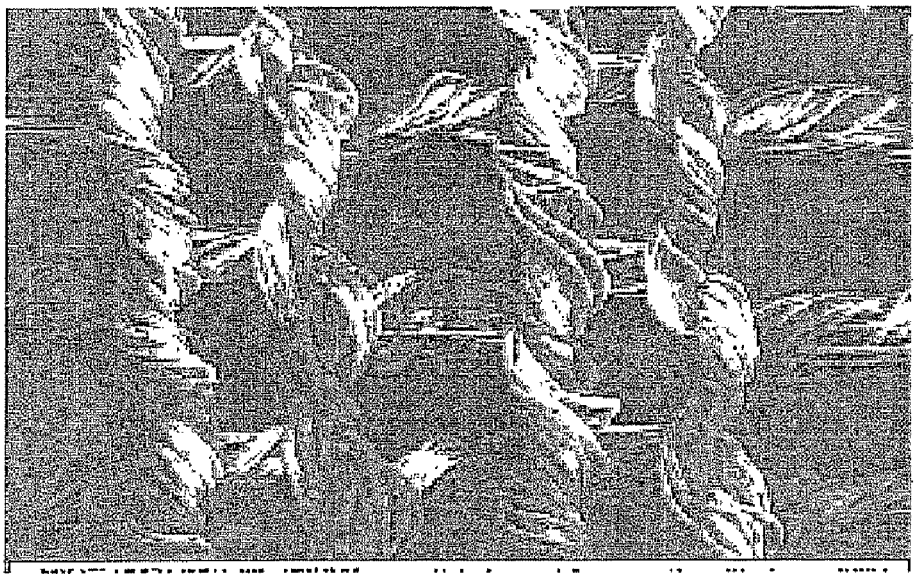
FIG. 12*b* is a scanning electron micrograph (SEM) representation of a fabric from the same composite yarn, the fabric being in a stretched condition.

Example 6 of the Invention (FIGS. 12*a*, 12*b*)

A fabric (100) was produced using electrically conductive elastic composite yarn (70) described in Invention Example 3. The fabric (100) was in the form of a knitted tube made on a Lonati 500 hosiery machine. This knitting process permits examination of the knittability of the yarn (70) under critical knitting conditions. This electrically conductive elastic composite yarn (70) yarn processed very well with no breaks providing a uniform knitted fabric (100). An SEM picture of this fabric (100) is given in FIG. 12*a* in a relaxed state and in FIG. 12*b* in stretched state.

Figure 13A:
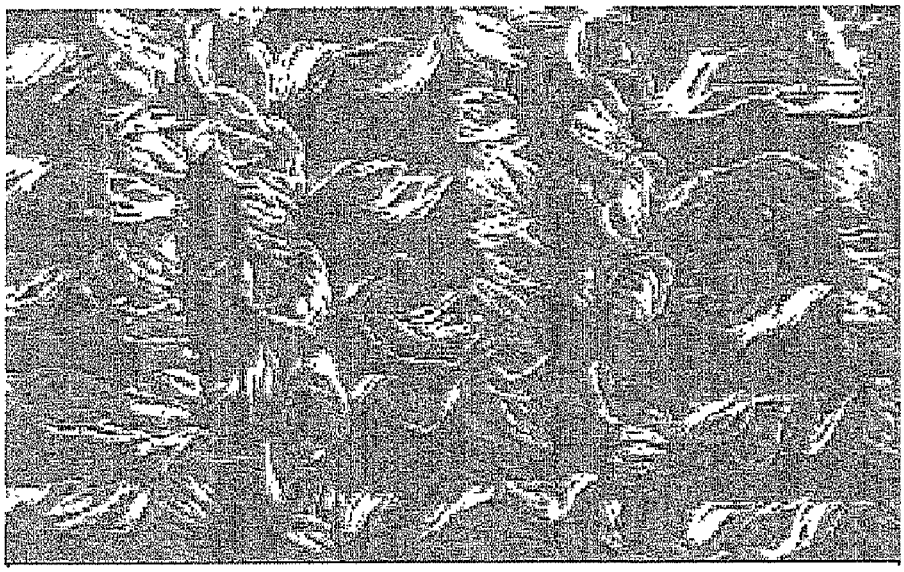
Figure 13B:
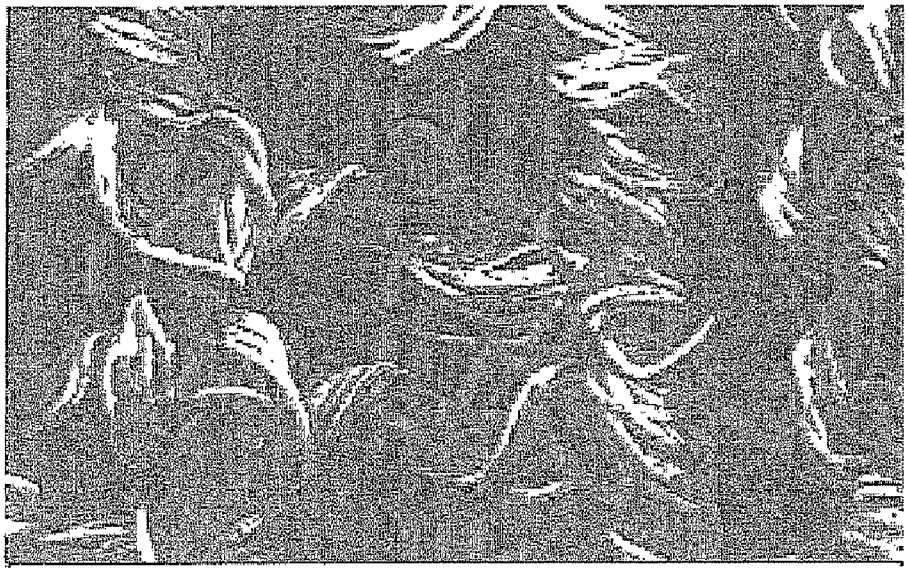
FIG. 13*b* is a scanning electron micrograph (SEM) representation of same fabric in a stretched condition.

Example 7 of the Invention (FIGS. 13*a*, 13*b*)

A fabric (110) was produced using the electrically conductive elastic composite yarn (80) described in Invention Example 4 of the invention. The fabric (110) again made in a Lonati 500 hosiery machine as in Example 6. The electrically conductive elastic composite yarn (80) processed very well with no breaks providing a uniform knitted fabric. An SEM picture of this fabric (110) is given in FIG. 13*a* in the relaxed state and in FIG. 13*b* in stretched state.

The examples are for the purpose of illustration only. Many other embodiments falling within the scope of the accompanying claims will be apparent to the skilled person.

What is claimed is:

1. A method for forming an electrically conductive elastic composite yarn comprising:

an elastic member having a relaxed length (L); and at least one conductive covering filament surrounding the elastic member, the method comprising the steps of:

drafting the elastic member to a drafted length N×L where N is from about 1.2 to about 8.0;

wrapping the conductive covering filament having a length about the drafted length of the elastic member;

wrapping a stress-bearing member having a length shorter than the length of the conductive covering filament over the conductive covering filament and about the drafted length of the elastic member; and thereafter allowing the elastic member to relax.

2. The method of claim 1 wherein the electrically conductive elastic composite yarn further comprises a second conductive covering filament surrounding the elastic member, the method further comprising the steps of:

wrapping a second conductive covering filament about the drafted length of the elastic member and the first conductive covering filament before allowing the elastic member to relax.

3. The method of claim 1 wherein the stress-bearing member is an inelastic synthetic polymer yarn.

4. The method of claim 3 wherein the electrically conductive elastic composite yarn further comprises a second inelastic synthetic polymer yarn surrounding the elastic member, the method further comprising the steps of:

wrapping a second stress-bearing member of inelastic synthetic polymer yarn about drafted length of the elastic member, the conductive covering filament and the first inelastic synthetic polymer yarn before allowing the elastic member to relax.

5. The method of claim 1, wherein the elastic member comprises a synthetic bicomponent multifilament textile yarn.

6. The method of claim 1, wherein the stress-bearing member is a bicomponent yarn or a multifilament yarn blend.

7. The method of claim 1, wherein the elastic member is drafted to a drafted length N×L where N is from about 1.2 to about 5.0.

8. The method of claim 1, wherein the conductive covering filament is wrapped up to about 10,000 turns about the drafted length of the elastic member.

* * * * *